US007571968B2

(12) United States Patent
Ji et al.

(10) Patent No.: US 7,571,968 B2
(45) Date of Patent: Aug. 11, 2009

(54) FRONT RELEASE LOCK WITH DISCONNECT LOCK FOR A DRAWER SLIDE

(75) Inventors: Weigang Ji, Singapore (SG); Wenming Yang, Singapore (SG); Alfred E. Barry, Jr., Atlanta, GA (US); Meng Kee Koh, Singapore (SG)

(73) Assignee: Central Industrial Supply Company, Tuscon, AZ (US)

( * ) Notice: Subject to any disclaimer, the term of this patent is extended or adjusted under 35 U.S.C. 154(b) by 308 days.

(21) Appl. No.: 11/598,246

(22) Filed: Nov. 9, 2006

(65) Prior Publication Data

US 2008/0111457 A1 May 15, 2008

(51) Int. Cl.
*A47B 88/04* (2006.01)

(52) U.S. Cl. ..... 312/333; 312/334.44

(58) Field of Classification Search ..... 312/330.1, 312/333, 334.1, 334.7, 334.8, 334.11, 334.44, 312/334.46, 319.1; 384/20, 21, 22
See application file for complete search history.

(56) References Cited

U.S. PATENT DOCUMENTS

| | | | | |
|---|---|---|---|---|
| 5,433,517 | A | 7/1995 | Fleisch | |
| 6,367,899 | B1 | 4/2002 | Hwang et al. | |
| 6,390,575 | B1 | 5/2002 | Chen et al. | |
| 6,412,891 | B1 * | 7/2002 | Liang et al. | 312/334.44 |
| 6,464,311 | B2 | 10/2002 | Liang et al. | |
| 6,585,337 | B1 | 7/2003 | Chen et al. | |
| 6,601,933 | B1 | 8/2003 | Greenwald | |
| 6,851,774 | B2 | 2/2005 | Chen et al. | |
| 6,860,575 | B2 | 3/2005 | Chen et al. | |
| 6,883,885 | B2 | 4/2005 | Judge et al. | |
| 6,899,408 | B2 | 5/2005 | Chen et al. | |
| 6,935,710 | B2 | 8/2005 | Chen et al. | |
| 6,945,619 | B1 * | 9/2005 | Chen et al. | 312/334.47 |
| 2002/0021061 | A1 * | 2/2002 | Lammens | 312/334.44 |
| 2003/0034720 | A1 | 2/2003 | Milligan et al. | |
| 2003/0178922 | A1 | 9/2003 | Chen et al. | |
| 2003/0197453 | A1 | 10/2003 | Jurja | |
| 2004/0080245 | A1 | 4/2004 | Lammens et al. | |
| 2004/0207301 | A1 | 10/2004 | Chen et al. | |
| 2004/0239220 | A1 | 12/2004 | Yang | |
| 2005/0017614 | A1 | 1/2005 | Cirocco et al. | |

* cited by examiner

*Primary Examiner*—James O Hansen
(74) *Attorney, Agent, or Firm*—Mark W Handley

(57) ABSTRACT

A drawer slide (12) is provided with a front release lock (32) and disconnect lock (34) moveably mounted a first slide member (14) for engaging opposite sides of a stopper (28) mounted to a second slide member (16). A release linkage (22) is slidably secured to the first slide member (14) for moving the release lock (32) from a lock position to a release position, spaced apart from the stopper (28), to allow the first slide member (14) to retract into the second slide member (16). A disconnect linkage (24) is slidably secured to the first slide member (14) for moving the disconnect lock (34) from a retaining position to a disconnect position, spaced apart from the catch (30), to allow the first slide member (14) to be removed from the second slide member (16). The front release lock (32) and the disconnect lock (34) are slidably secured within a bracket (36) with bias springs (38, 40) urging the release lock (32) into the lock position and the disconnect lock (34) into the retaining position.

20 Claims, 19 Drawing Sheets

FRONT RELEASE LOCK WITH DISCONNECT LOCK FOR A DRAWER SLIDE

TECHNICAL FIELD OF THE INVENTION

The present invention relates in general to locks for drawer slides, and in particular to front release locks and disconnect locks for drawer slides for retaining chassis members of drawer slides in telescopically extended positions and for allowing removal of the chassis members from other members of the drawer slides.

BACKGROUND OF THE INVENTION

Prior art drawer slides have been used for moveably securing a chassis, such as a drawer, to various types of cabinets, such as equipment racks and the like. The drawer slides have been provided by elongate slide members having formed edges which are nested together in sliding engagement for telescopically moving between extended and retracted positions. Pairs of the drawer slides are typically mounted within a cabinet in a spaced apart alignment for securing to opposites sides of a chassis, such that the chassis is moveable outward of the cabinet in a cantilevered support arrangement. Various drawer slide locks have been provided for securing the drawer slides in the extended positions, both to prevent the chassis from being pushed back into the cabinet and to prevent inadvertent disassembly of the drawer slides. Some prior art drawer slides have included locks which are released by a user's finger pushing directly against a locking member to release the slides for from the extended positions for moving a chassis back into a cabinet, and to release one of the slide members for disconnecting from a mating slide member, such that the chassis may be disassembled from the cabinet. Drawer slides having locks which are directly engaged by a user's finger for release often create pinch points between adjacent slide members, in which a user's finger may be injured. To prevent injury from pinch points, other prior art drawer slides have been provided with slidably moving release members which have rearward portions engaging associated lock members and forward portions that the user may selectively operate to move the associated locks to release positions, releasing the drawer slides for moving back into the cabinet from the extended positions or releasing one of the slide members for moving from within a mating slide member to disconnect a chassis from a cabinet.

SUMMARY OF THE INVENTION

A front release lock with a disconnect lock is provided for securing a chassis member within an adjacent slide member of a drawer slide. In a preferred embodiment, the drawer slide is a three-part drawer slide having a chassis member, an intermediate member and a cabinet member which are slidably secured together in a telescopic arrangement. The front release lock retains the chassis member in an extended position, preventing the chassis member from moving back into the intermediate member. A front release linkage engages the front release lock and is selectively moved by a user to move the front release lock from a locking position to a release position, allowing the chassis member to be moved into the intermediate member from the extended position. The disconnect lock prevents the chassis member from moving outward of the intermediate member from the extended position and disengaging from the intermediate member. A disconnect linkage engages the disconnect lock and is slidably moved by a user to move the disconnect lock from a retaining position to a disconnect position, allowing the chassis member to be moved outward of the extended position and for disconnecting the chassis member from the intermediate member. Both the front release linkage and the disconnect linkage extend forward of respective lock members to prevent a user from having to reach into potential pinch points between mating slide members.

In one example of the present invention, a stopper member is mounted to the intermediate member for engaging between the release lock and the disconnect lock. The release lock is slidably mounted to the chassis member for lineally moving from the lock position to the release position. The disconnect lock is slidably mounted to the chassis member for lineally moving from the retaining position to the disconnect position. The release linkage is slidably secured to the chassis member and extends forward of the release lock for slidably moving to engage the release lock, such that movement of the release linkage along the first slide member moves the release lock from the lock position, disposed for engaging the stopper, to release position, spaced apart from engaging the stopper, wherein the release position is spaced apart from the lock position in a lineal direction which extends transverse to the longitudinal axis of the drawer slide. A disconnect linkage is slidably secured to the first slide member and extends from forward of the disconnect lock for engaging the disconnect lock, such that movement of the disconnect linkage along the first slide member moves the disconnect lock from a retaining position to a disconnect position, spaced apart from the disconnect position in a lineal direction which extends transverse to the longitudinal axis of the drawer slide. First and second bias springs are provided for urging the release lock into the lock position and the disconnect lock into the retaining position. At least one retainer member is mounted to the first slide member for slidably securing the release lock and the disconnect lock to the first slide member, such that the release lock and said disconnect lock are slidably moveable in respective ones of said lineal directions.

In one embodiment, a retainer member is provided by a lock bracket mounted in fixed relation to the first slide member, and having two slots. Each of the two slots receives a respective one of the release lock and the disconnect lock. The lock bracket further includes two pins, each extending into a respective one of the slots in the lock bracket for engaging bias springs located within cavities of respective ones of the release lock and the disconnect lock. The lock bracket further includes lips which extend from respective sides of the slots in the lock bracket, and slidably engage with lips extending from respective ones of the retainer lock and the disconnect lock.

In another embodiment, retainer members are provided which include a bracket member, guide block, an emboss, and a rivet pin mounted in fixed relation to the first drawer slide. The rivet pin slideably secures the front release lock to the first slide member for moving between the lock position and the release position, in a lineal direction which extends transverse to the longitudinal axis of the drawer slide. The bracket member includes a lip which slidably engages a lip on a rearward end of the release lock. An emboss slidably engages a forward side of the front release lock. The disconnect lock has lips on forward and rearward edges which slidably engage between a lip on the rearward end of the bracket member and a lip on the forward end of the guide block. Two leaf springs engage respective tops of the retainer lock and the disconnect lock to bias the retainer lock into the lock position and the disconnect lock into the retaining position.

DESCRIPTION OF THE DRAWINGS

For a more complete understanding of the present invention and the advantages thereof, reference is now made to the following description taken in conjunction with the accompanying Drawings in which

FIG. 1 is a perspective view of a drawer slide having a chassis member, an intermediate member, and a cabinet member;

FIG. 2 is a perspective view of a portion of the chassis member having a front release lock with disconnect lock assembly;

FIG. 3 is an enlarged perspective view of a portion of the chassis member having the front release lock with disconnect lock assembly;

FIG. 4 is an exploded, perspective view of the chassis member of the drawer slide showing various components of the front release lock with disconnect lock assembly;

FIG. 5 is an exploded, partial perspective view of the forward end of the intermediate member and a stopper which provides a catch;

FIG. 6 is an exploded, partial perspective view of the chassis member, the intermediate member, and the front release lock with disconnect lock assembly;

FIGS. 7 and 8 are perspective views of opposite sides of a grip member;

FIGS. 9 and 10 are perspective views of opposite sides of the disconnect lock;

FIGS. 11 and 12 are perspective views of opposite sides of the front release lock;

FIGS. 13 and 14 are perspective views of opposite sides of a lock member bracket;

FIGS. 15 and 16 are perspective views of opposite sides of a stopper member;

FIG. 17 is a perspective view of the front release linkage;

FIG. 18 is a perspective view of the disconnect linkage;

FIG. 19 is a perspective view of an alternative chassis member of a drawer slide having an alternative front release lock and disconnect lock;

FIG. 20 is an enlarged, perspective view of a portion of the chassis member of FIG. 19;

FIG. 21 is an exploded, perspective view of the chassis member and the front release lock and disconnect lock assembly;

FIG. 22 is an exploded, partial perspective view of the chassis member, the intermediate member, and the front release lock and disconnect lock assembly;

FIGS. 23 and 24 are perspective views of opposite sides of a grip member;

FIGS. 25 and 26 are perspective views of opposite sides of a spring retainer;

FIG. 27 is a perspective view of a bias spring member;

FIGS. 28 and 29 are perspective views of opposite sides of the disconnect lock;

FIGS. 30 and 31 are perspective views of opposite sides of the front release lock;

FIGS. 32 and 33 are perspective views of opposite sides of a bracket;

FIG. 34 is a perspective view of the disconnect linkage; and

FIG. 35 is a perspective view of the front release linkage.

DETAILED DESCRIPTION OF THE INVENTION

Figure 1:
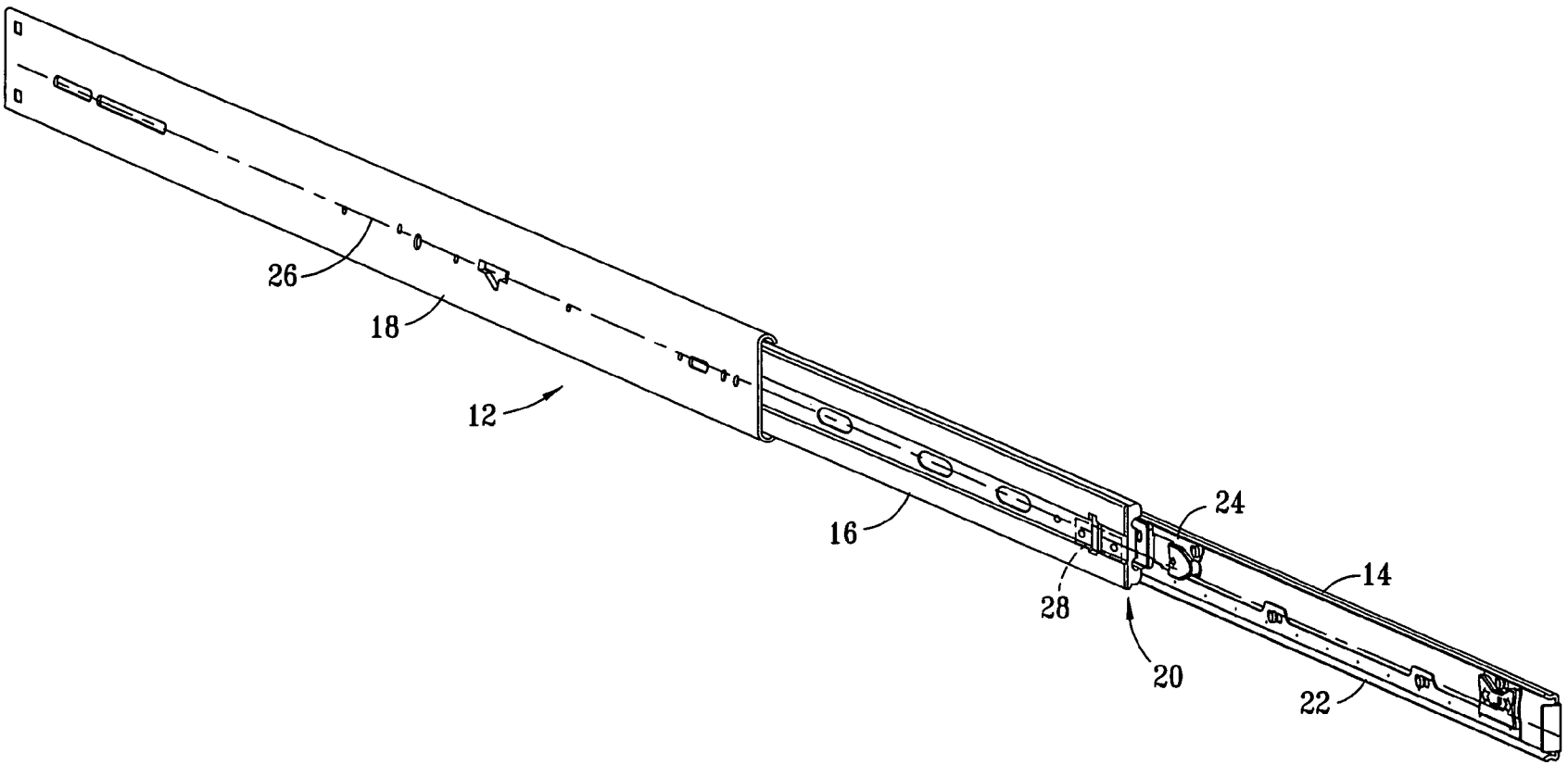
FIGS. 1 through 35 show various aspects for a front release with disconnect feature for a drawer slide devices made according to the present invention, as set forth below.

FIG. 1 is a perspective view of a drawer slide 12 having a chassis member 14, which provides a first slide member, an intermediate member 16, which provides a second slide member, and a cabinet member 18, which provides a third slide member. A front release lock with disconnect lock assembly 20 is provided for selectively locking the chassis member 14 in an extended position, in which the chassis member is extended from within the intermediate member 16, and for selectively locking the chassis member 14 to prevent removal from the intermediate member 16. A front release linkage 22 is provided for selectively operating the front release lock and disconnect lock assembly 20 for releasing the chassis member 14 for moving into the intermediate member 16 from the extended position. A disconnect linkage 24 is provided for selectively operating the front release lock and disconnect lock assembly 20 for disconnecting the chassis member 14 from the intermediate member 16, such that the chassis member 16 may slide forward of the intermediate member 16 for removal of the chassis member 14 from the intermediate member 16. A stopper member 28 is mounted to the intermediate member 16 to provide a catch for use in operation of the front release lock and disconnect lock assembly 20. The stopper 28 has a protrusion 30 which provides a catch for engagement with the front release lock and disconnect lock assembly 20.

Figures 2, 3:
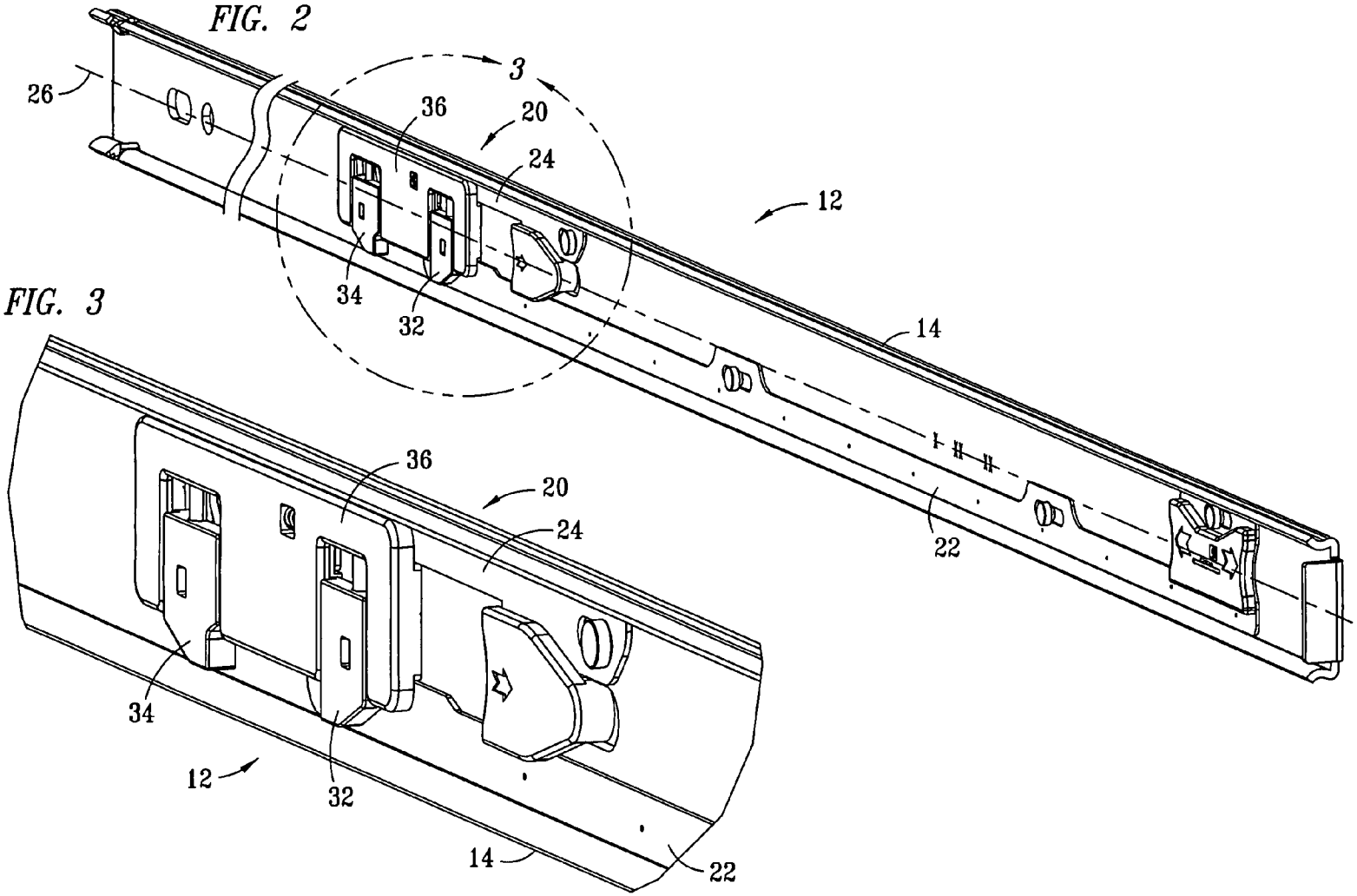

FIG. 2 is a perspective view and FIG. 3 is an enlarged perspective view of a portion of the chassis member 14 showing the front release lock and disconnect lock assembly 20. The front release lock and disconnect lock assembly 20 includes a front release lock 32 and a disconnect lock 34 which are slidably mounted within a bracket 36 for moving transverse to the longitudinal axis 26. The bracket 36 provides a housing for securing the front release lock 32 and the disconnect lock 34 to the chassis member 14. The front release lock 32 and disconnect lock 34 are biased to extend downward from within the bracket 36 by bias springs 38 and 40, respectively (shown in FIG. 4A). A bias spring 42 is mounted within the bracket 36 for urging the disconnect linkage 24 into a forwardly disposed position. (Spring 42 is shown in FIG. 4A).

Figure 4:
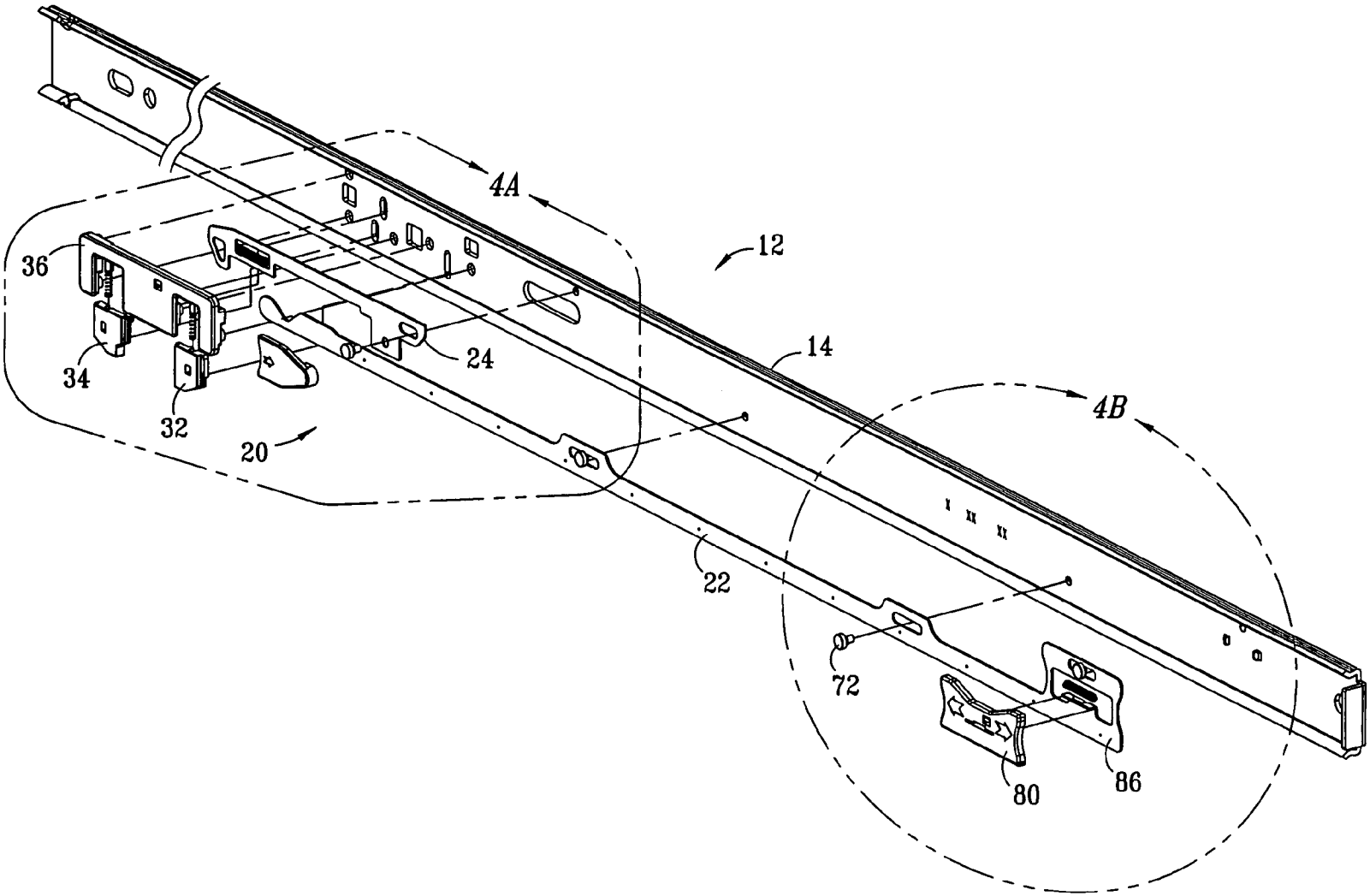
Figure 4A:
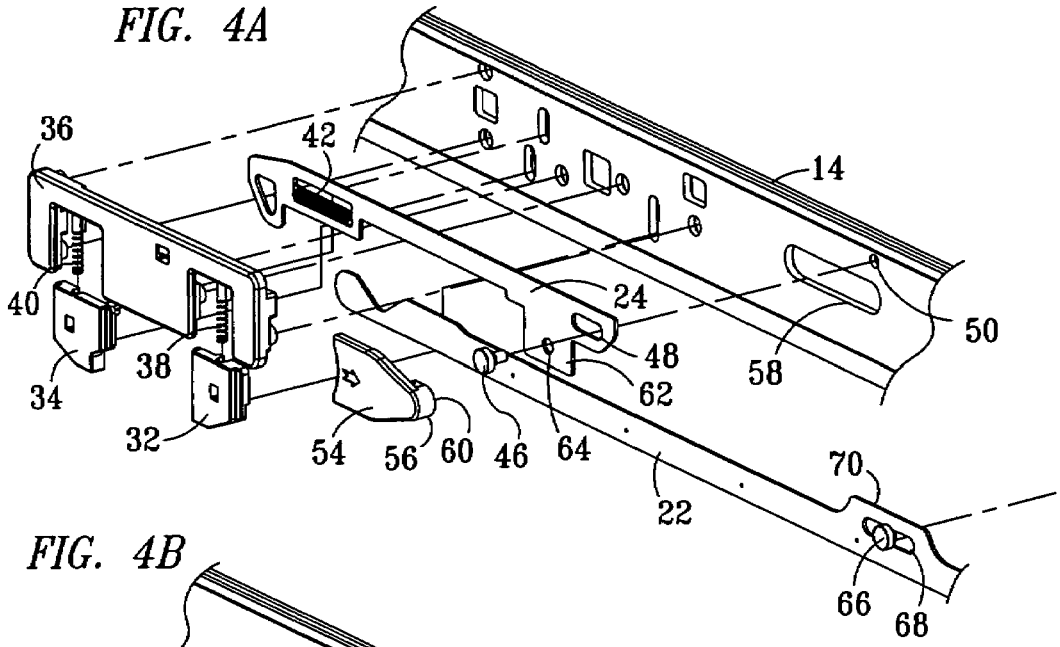
FIGS. 4A and 4B are enlarged views of portions of the drawer slide of FIG. 4.
Figure 4B:
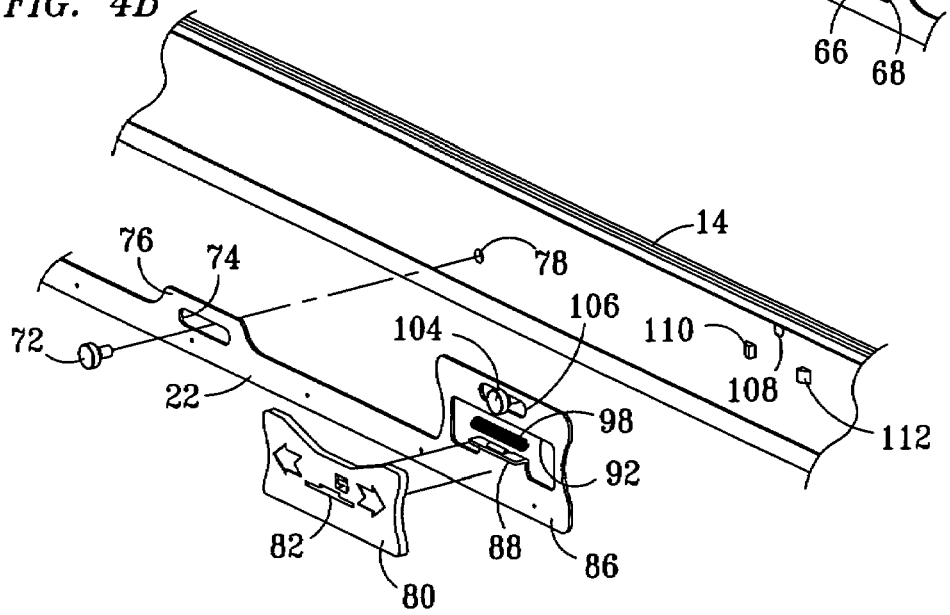

FIG. 4 is an exploded, perspective view of the chassis member 14 of the drawer slide 12 showing various components of the front release lock and disconnect lock assembly 20. FIGS. 4A and 4B are enlarged perspective views of portions of the chassis member 14 of FIG. 4. The two coil springs 38 and 40 are located within the respective ones of the release lock 32 and the disconnect lock 34 for biasing respective ones of the release lock 32 and the disconnect lock 34 downward and from within the bracket 36 for engaging on opposite sides of the protrusion 30 of the stopper 28. The coil spring 42 is located within the spring slot 44 in the bracket 36 and within a window 52 of the disconnect linkage 24 for urging the disconnect linkage 24 into a forwardly disposed position. A rivet 46 extends through a slot 48 in the disconnect linkage 24 and into a mounting hole 50 within a sidewall of the chassis member 14. A grip member 54 has two tabs 56 (see also FIG. 6A) which define protuberances which fit within a guide slot 58 defined by a window extending through the sidewall of the chassis member 14. The tabs 56 extend within the guide slot 58 for determining the length of travel which the disconnect linkage 24 slidably moves along longitudinal axis 26 of the chassis member 14. Lips 60 extend on outward end portions of the tabs 56, spaced apart from a surface of the main body of the grip member 54, for securing the tab 62 of the disconnect linkage 24 between the two tabs 56 and the main body of the grip member 54. (See FIG. 6A). A hole 64 is defined in the tab 62 of the disconnect linkage 24 for receiving a mounting fastener or protuberant tab which may extend from the grip member 54. A rivet 66 extends through a slot 68 defined by a window and a tab 70 of the front release linkage 22 for securing within a mounting hole 50 defined in the sidewall of the chassis member 14.

Figure 6:
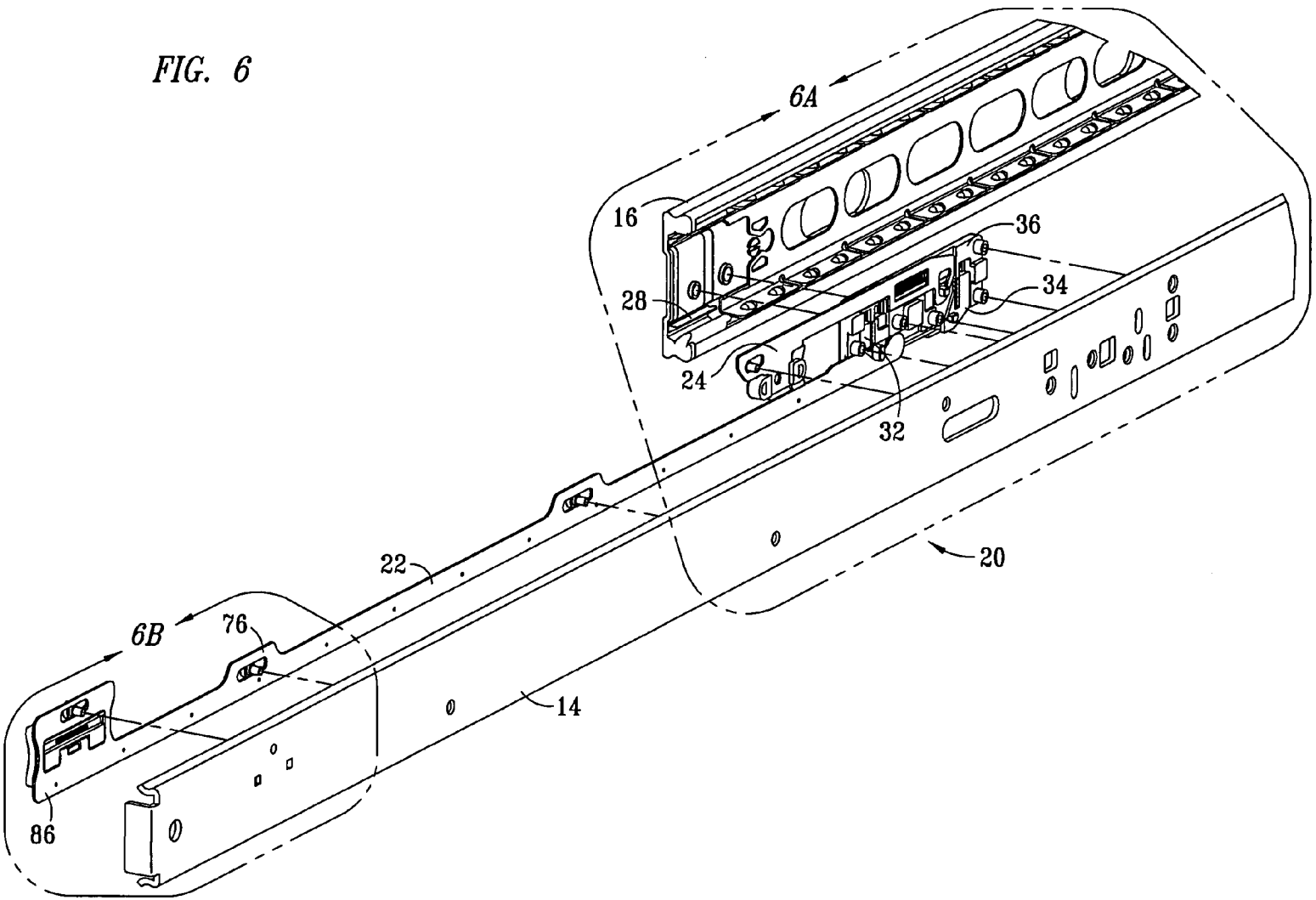
Figure 6A:
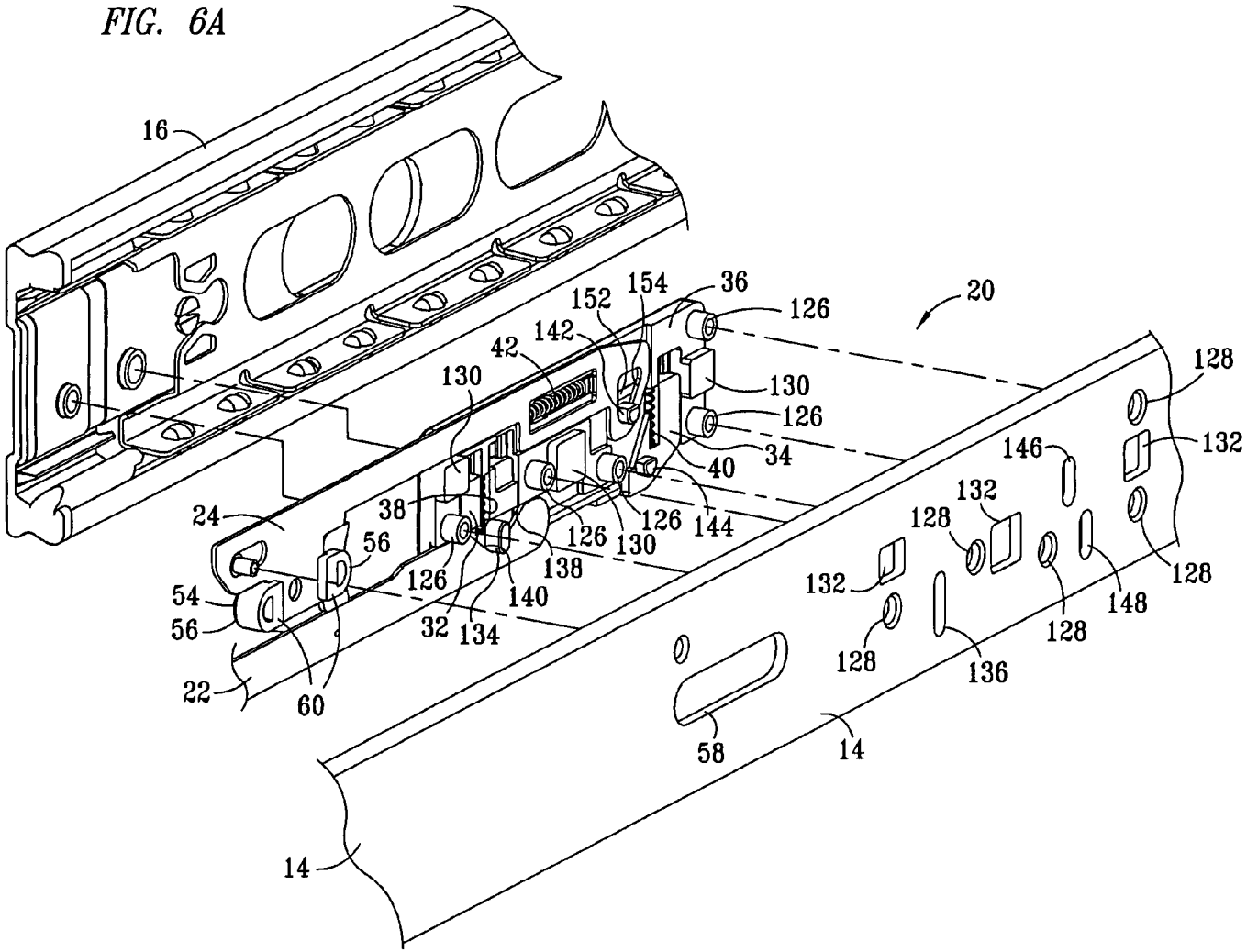
FIGS. 6A and 6B are enlarged views of portions of FIG. 6.
Figure 6B:
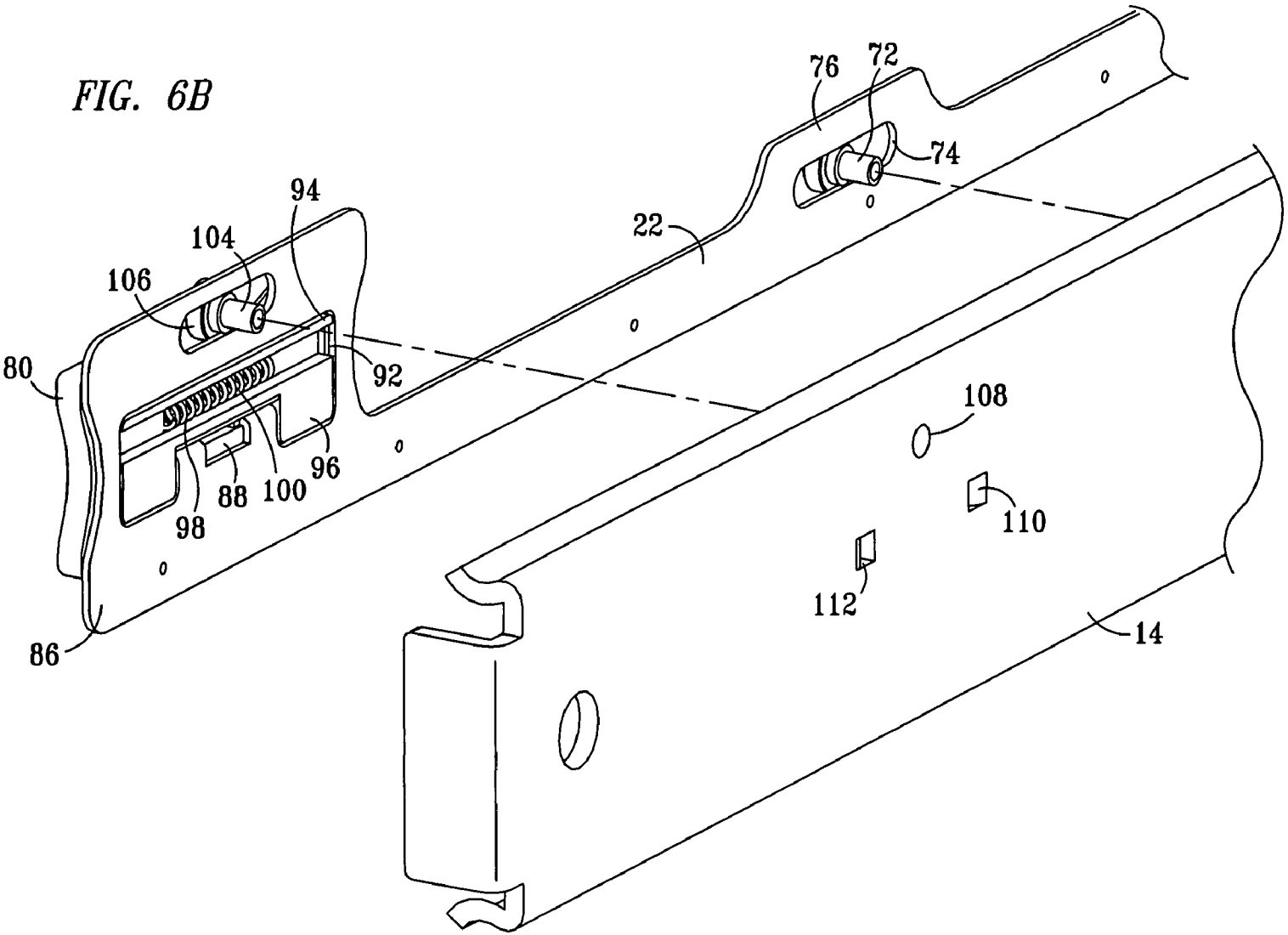
Figure 7:
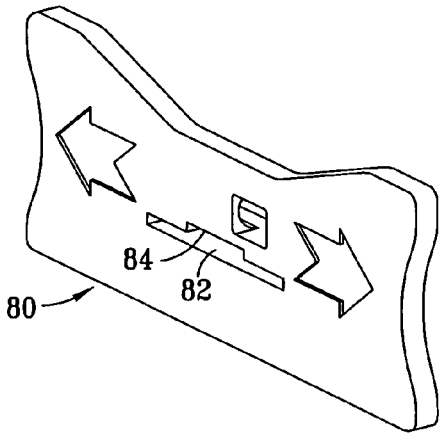
Figure 8:
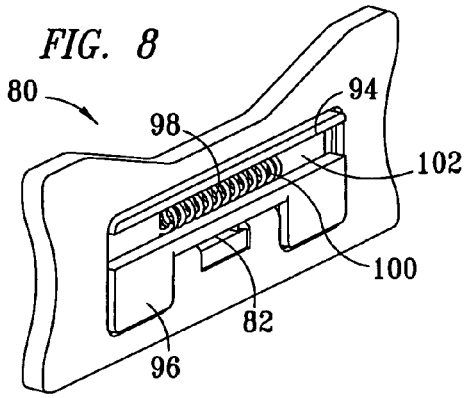

FIGS. 4B and 6B show a rivet 72 which extends through a slot 74, defined by a window in a tab portion 76 of the front release linkage 22, and into a mounting hole 78 provided in the sidewall of the chassis member 14. A grip member 80 is provided for mounting to an end tab 86 defined in a forward end portion of the front release linkage 22. A mounting tab 88 extends outward from the end tab 86 adjacent an aperture 92 in the end tab 86. Preferably, the mounting tab 88 extends orthogonal to a planar surface of the end tab 86 and the longitudinal axis 26 of the drawer slide 12, and is received within a mounting hole 82 which is defined by a window extending through the body of the grip member 80. A spring 98 is provided for engaging between two spring tabs 110 and 112 defined by lance forms protruding outwardly from the sidewall of the chassis member 14. The two tabs 110 and 112 define two stop protuberances for engaging opposite ends of the spring 98. The spring 98 urges the front release linkage 22 to a neutral position when pushed forward or rearwardly of the neutral position along the longitudinal axis 26. Referring to FIG. 6B, and FIGS. 7 and 8, which are perspective views of opposite sides of the grip member 80. The cavity 100 extends into the body of the grip member 80, adjacent a slot 102, for receiving the spring 98. A slot 102 provides a recess for receiving the spring tabs 110 and 112 provided by the lance portions of the sidewalls of the chassis member 14. The tabs 110 and 112 engage the forward and rearward ends of the spring 98. The mounting hole 82 extends through the main body of the grip member 80. The mounting hole 82 has the upper portion 84. The spring 98 fits within a spring cavity 100 defined on one side of the grip member 80. The grip member 80 further includes two raised surfaces 94 and 96 which have peripheries defining peripheral edges which are of a shape for fitting substantially flush against a profile defined by edges of the aperture 92 in the end tab 88 of the release member 22.

Figure 5:
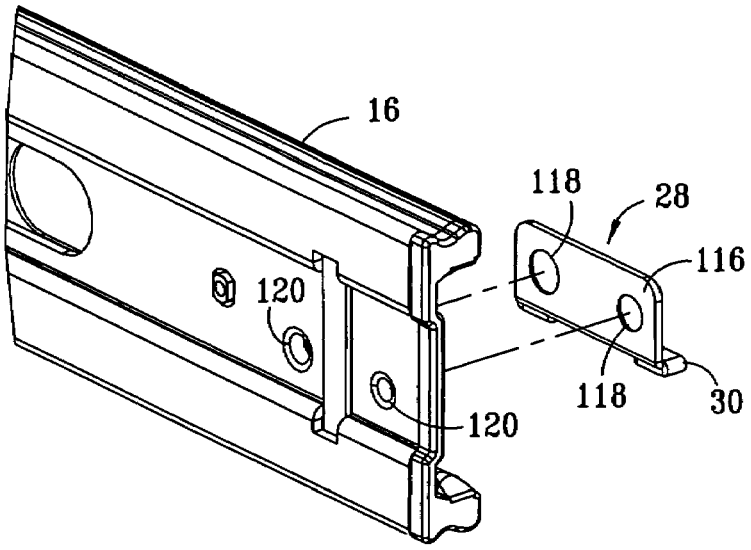
Figure 15:
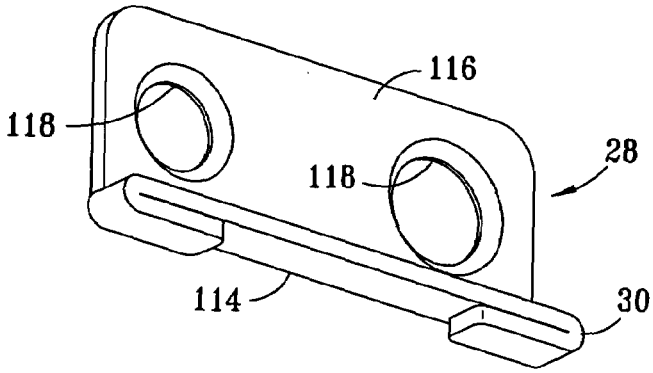
Figure 16:
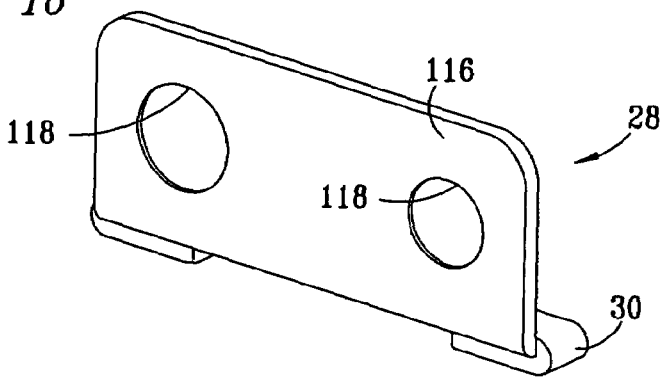

FIG. 5 is an exploded, partial perspective view of the forward end of the intermediate member 16 showing the stopper 28 which provides a catch for the front release lock and disconnect lock assembly 20. FIGS. 15 and 16 are perspective views of opposite sides of the stopper 28. The stopper 28 has a planar back plate 116 and a transverse, planer portion 114 which extends orthogonal to the back plate 116 to define the protrusion 30. Two spaced apart mounting holes 118 are defined in the back plate 116 for passing fasteners, preferably rivets, which extend into two spaced apart mounting holes 120 in the sidewall of the intermediate member 16. The protrusion 30 extends for fitting in the space between the release lock 32 and the disconnect lock 34 (shown in FIG. 4A).

FIG. 6 is an exploded partial perspective view of the chassis member 14, the intermediate member 16, and the front release lock and disconnect lock assembly 20, and FIGS. 6A and 6B are enlarged views of portions of FIG. 6. In FIG. 6A, the stopper 28 is shown mounted to sidewall of the intermediate member 16 with the protuberant portion 30 extending towards the chassis member 14. The front release lock and disconnect lock assembly 20 is shown fully assembled, but spaced apart from the sidewall of the chassis member 14. The bracket 36 has mounting tabs 126 and locating tabs 130 which are provided for registering with respective ones of mounting holes 128 and the locating holes 132 in the sidewall of the chassis member 14. Preferably, the mounting tabs 126 will either be heat staked, riveted or secured by other types of fasteners, to the sidewall of the chassis member 14 such that the bracket 36 is fixedly secure, in non-moveable relation to the sidewall of the chassis member 14. A guide tab 134 extends from the front release lock 32 toward the chassis member fitting within a guide slot 136 formed in the sidewall of the chassis member 14. A cam notch 138 defines an opening which extends into an upper side of the front release linkage 22 to define a cam surface 140 which engages the guide tab 134 of the front release lock 32. The cam notch 138 has peripheral edge, or a profile, which defines the cam surface 140 such that forward or rearward movement of the front release linkage 22 from the position shown in FIG. 6A moves the guide tab 134 upward. Preferably, the cam notch 138 had a substantially V-shaped edge which defines the cam surface 140, and in other embodiments may be of other shapes, such as U-shaped or arcuately-shaped to extend upwards from opposite sides of a neutral position portion in which the guide tab 134 is disposed within the opening 138. The guide tab 134 and the front release lock 32 define a follower which the cam surface 140 moves aside of the protrusion 30 of the stopper 28, such that the chassis member 14 may be moved from the extended position back into the intermediate member 16.

Two guide tabs 142 and 144 define protuberances which extend outwardly from the disconnect lock 34 for extending into respective guide slots 146 and 148 in the sidewall of the chassis member 14. A cam aperture 152 provides an opening in the rearward end of the disconnect linkage 24, having peripheral edges which define a cam surface 154 for engaging the protuberant guide tab 142 of the disconnect lock 34. Preferably, the cam aperture 152 is formed of a shape to define an edge providing the cam surface 154 which extends with a slope such that forward movement of the disconnect linkage 24 causes the cam surface 154 to push upward against the guide tab 142, urging the disconnect lock 36 to move upward and aside of the protrusion 30 of the stopper 28, such that the chassis member 14 may be removed from within the intermediate member 16. The guide tab 142 provides as a follower for engagement with the cam surface 154. The spring 42 is shown extending within the cavity 44 in the bracket 36 (see FIG. 14) and the window 52 of the disconnect linkage 24 (see FIG. 18).

Figure 9:
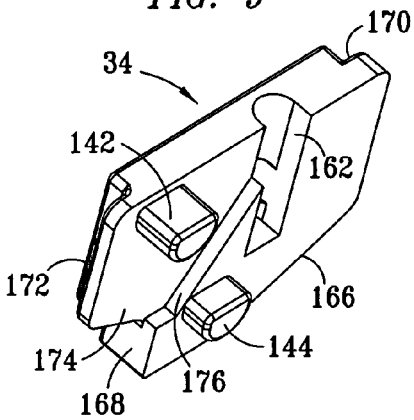
Figure 10:
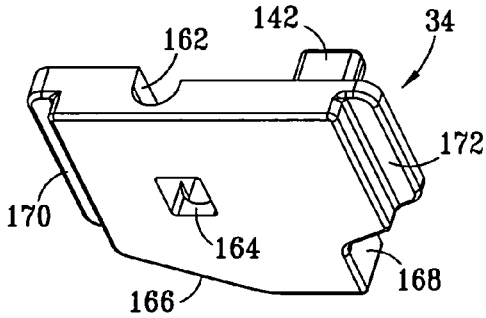

FIGS. 9 and 10 are perspective views of opposite sides of the disconnect lock 34. The two guide tabs 142 and 144 extends outwardly from a side of the disconnect lock 34 to define protuberances which extend into respective ones of the guide slots 146 and 148. A spring cavity 162 extends into the top of the body of the disconnect lock 34 for receiving the coil spring 40. A window 164 extends through the main body of the disconnect lock 34 and into the spring cavity 162. A tapered surface 166 is provided on a rearward portion of a lower end of the disconnect lock 34 such that engagement of the tapered surface 166 with the protuberance 30 of the stopper 28 will urge the disconnect lock to move upward against the force of the bias spring 40 and aside of the protuberance 30 for passing the disconnect lock 34 over the stopper 28 when inserting the chassis member 14 into the intermediate member 16 from a removed position. A stop surface 168 is defined on the forward end of the disconnect lock 34 for engaging the rearward end, or inward end, of the protuberance 30 of the stopper 28 to prevent removal of the chassis member 14 from within the intermediate member 16 once the disconnect lock 34 is located rearward of the stopper 28. Lips 170 and 172 are provided for slidably engaging with respective ones of lips 208 in a slot 206 of the bracket 36, slidably retaining the disconnect lock between the bracket 36 and the sidewall of the chassis member 14. (See FIGS. 13 and 14). A recessed surface 174 is provided for receiving the forward end of the disconnect linkage 24, and defines an edge surface 176.

Figure 11:
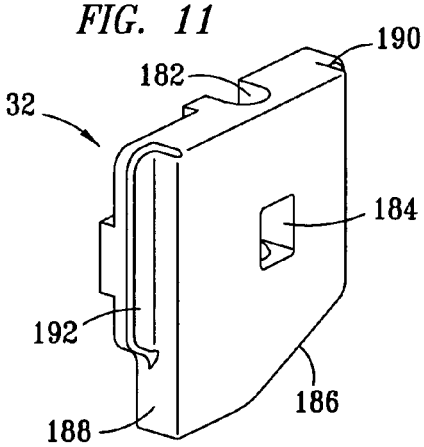
Figure 12:
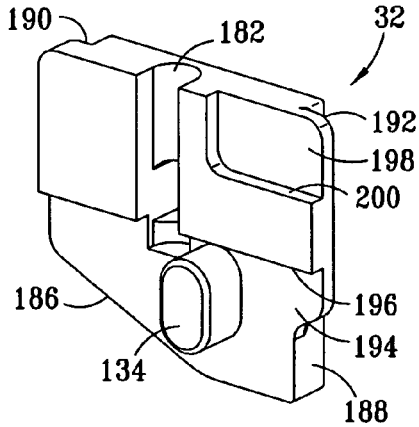

FIGS. 11 and 12 are perspective views of opposite sides of the front release lock 32. The guide tab 134 extends outward from a side of the front release lock 32. A spring cavity 182 extends it to the top of the body of the front release lock 32 for receiving the coil spring 38. A window 184 extends from an outward side of the disconnect lock 32 into the spring cavity 182. A forward portion of a lower end of the release lock 32 has a tapered surface 186, such that when the chassis member 14 is being moved outward from within the intermediate member 16, the tapered surface 186 will engage the rearward end, or inward end, of the protuberant portion 30 of the stopper 28 and move the release lock 32 upwards against the force of the bias spring 38, such that the release lock 32 will pass over the protuberance 30 of the stopper 28. Once the release lock 32 extends beyond the outward side of the protuberant portion 30, the bias spring 40 will urge the release lock 32 downward such that a rearwardly facing stop surface 188 of the release lock 32 engages the forward end, or outward end, of the protuberance 30 of the stopper 28. Lips 190 and 192 are provided on opposite sides of the disconnect lock 32 for slidably engaging respective ones of the lips 208 in the slot 204 of the bracket 36 to slidably retain the front release lock 32 between the bracket 36 and the sidewall of the chassis member 14. (See FIGS. 13 and 14). A recess surface 194 defines an edge 196, and provides clearance to allow movement of the front release linkage 22 between the release lock 32 and the sidewall of the chassis member 14. A recessed surface 198 defines an edge 200, and provides clearance to allow a portion of the disconnect linkage 24 to move between the surface 198 and the sidewall of the chassis member 14.

Figure 13:
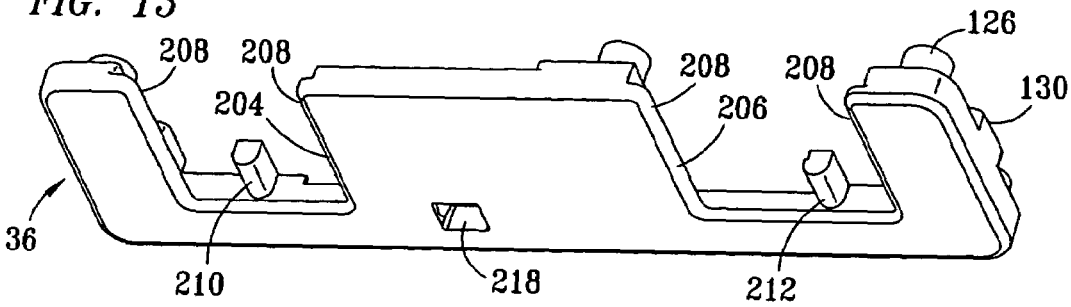
Figure 14:
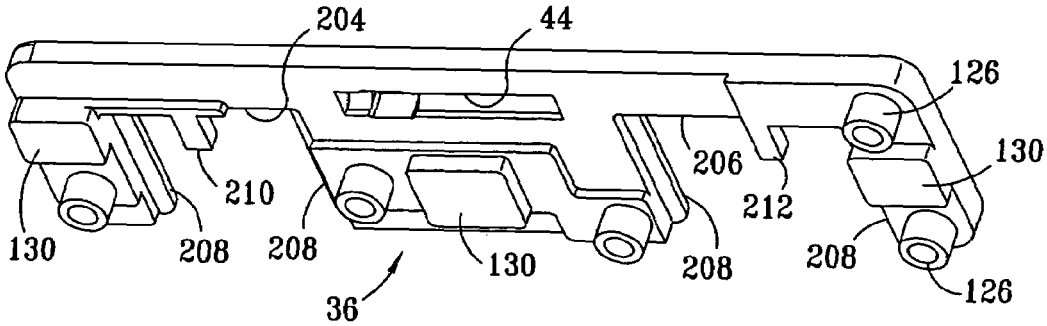

FIGS. 13 and 14 are perspective views of opposite sides of the bracket 36. The mounting tabs 126 and the locating tabs 130 extend from a side of the bracket 36 facing the chassis member 14 for engaging within respective ones of the mounting holes 128 and the locating holes 132 in the sidewall of the chassis member 14. (See FIG. 6A). Guide slots 204 and 206 are provided for slidably receiving respective ones of the front release lock 32 and the disconnect lock 34. The lips 208 are provided for slidably engaging respective ones of the lips 170 and 172 of the disconnect lock 34, and the lips 190 and 192 of front release lock 32. Spring stop tabs 210 and 212 extend downward for engaging ends of respective ones of the bias springs 38 and 40, which urge respective ones of the front release lock 32 and the disconnect lock 34 downward within the slots 204 and 206. The spring slot 44 extends through a side of the bracket 36 for receiving the coil spring 42. A window 218 extends from one side of the bracket 36 into the slot 216.

Figures 17, 18:
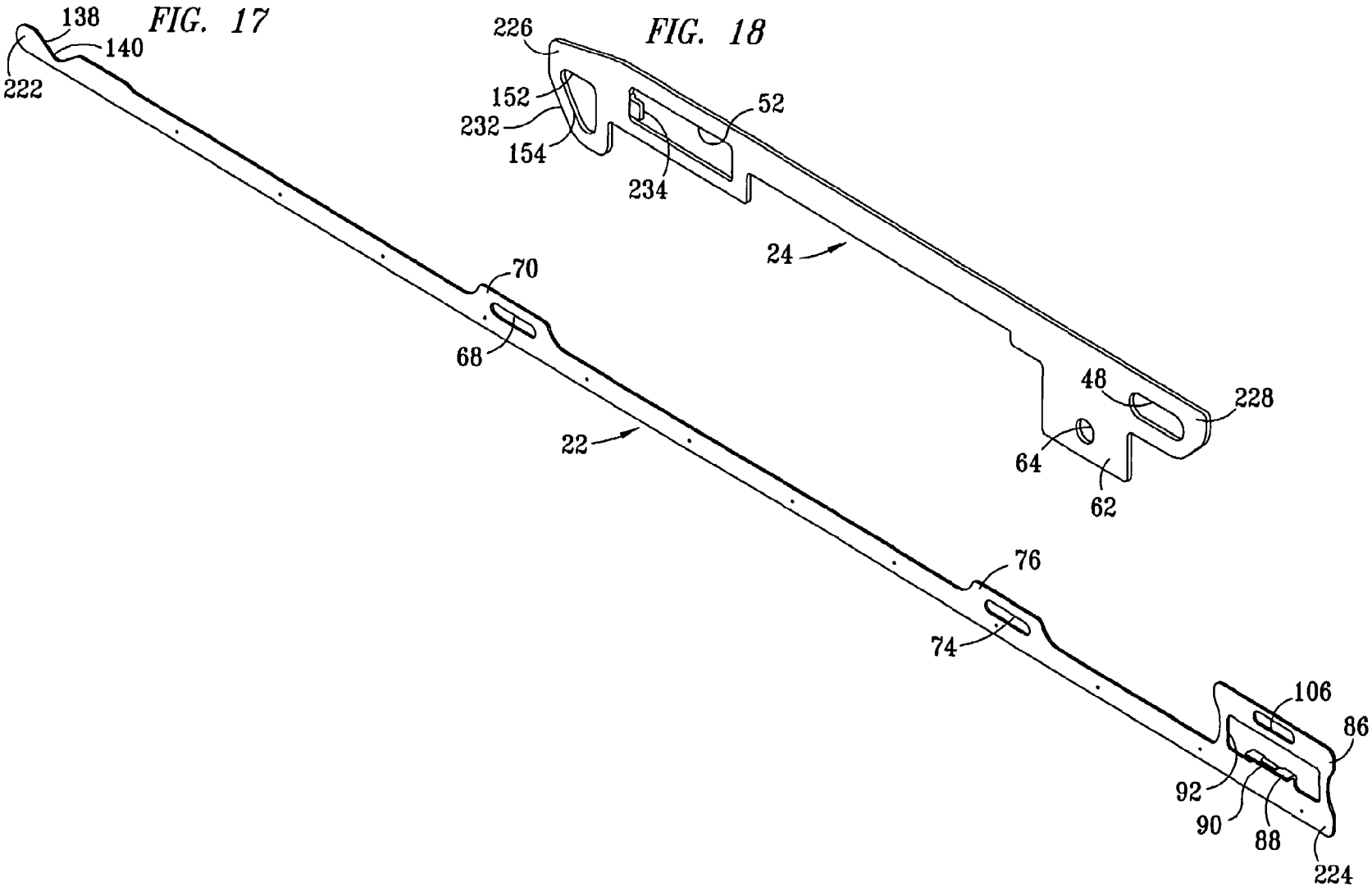

FIG. 17 is a perspective view of the front release linkage 22. The front release linkage is formed of a strip of metal having a rearward end 222 with the notch 138 formed therein to provide an opening which defines the cam surface 140. The slot 68 in the tab 70, and the slot 78 and the tab 80 are also shown. The end 224 of the front release linkage 22 has the tab portion 86 with the window 92 and the slot 106 formed therein. The mounting tab 88 extends preferably orthogonal to a planar surface of the tab portion 86, and includes an upwardly extending, protuberant portion 90.

FIG. 18 is a perspective view of the disconnect linkage 24. The disconnect linkage 24 is provided by a strip of metal having an end 226 which includes the cam aperture 152 defining the cam surface 154. The rearward end 226 further has an angled surface 234 which fits alongside the edge 176 defined adjacent the recessed surface 174 in the disconnect lock 34. A tab 232 extends from a rearward end of the window 230 to provide a stop for engaging the rearward end of the spring 42 which fits within the recess 44 in the bracket 36. Since the bracket 36 is fixed in relation to the chassis member 14, the tab 234 will push against the end of the spring 42 which provides a biasing force urging the disconnect linkage 24 to move rearward as the disconnect linkage 22 is moved forward in relation to the chassis member 14. An optional mounting hole 64 is shown in tab 62. The slot 48 is shown on the end 228 of the disconnect linkage 24.

Figure 19:
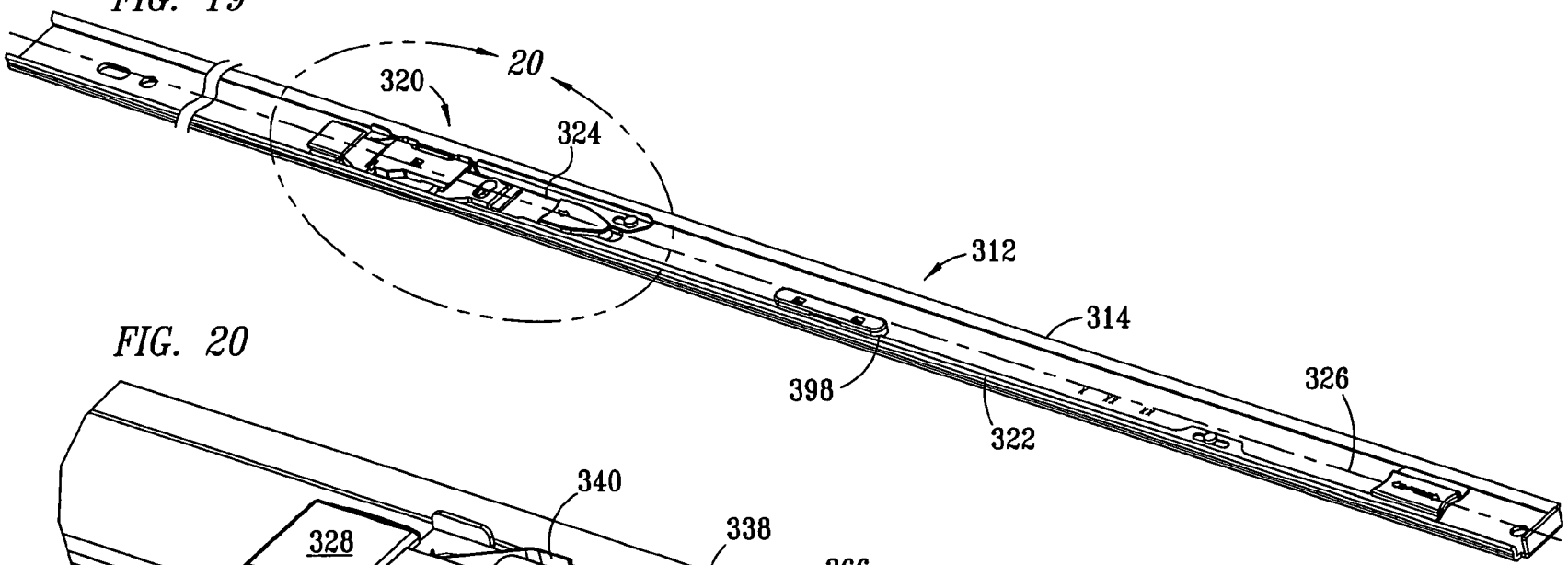
Figure 20:
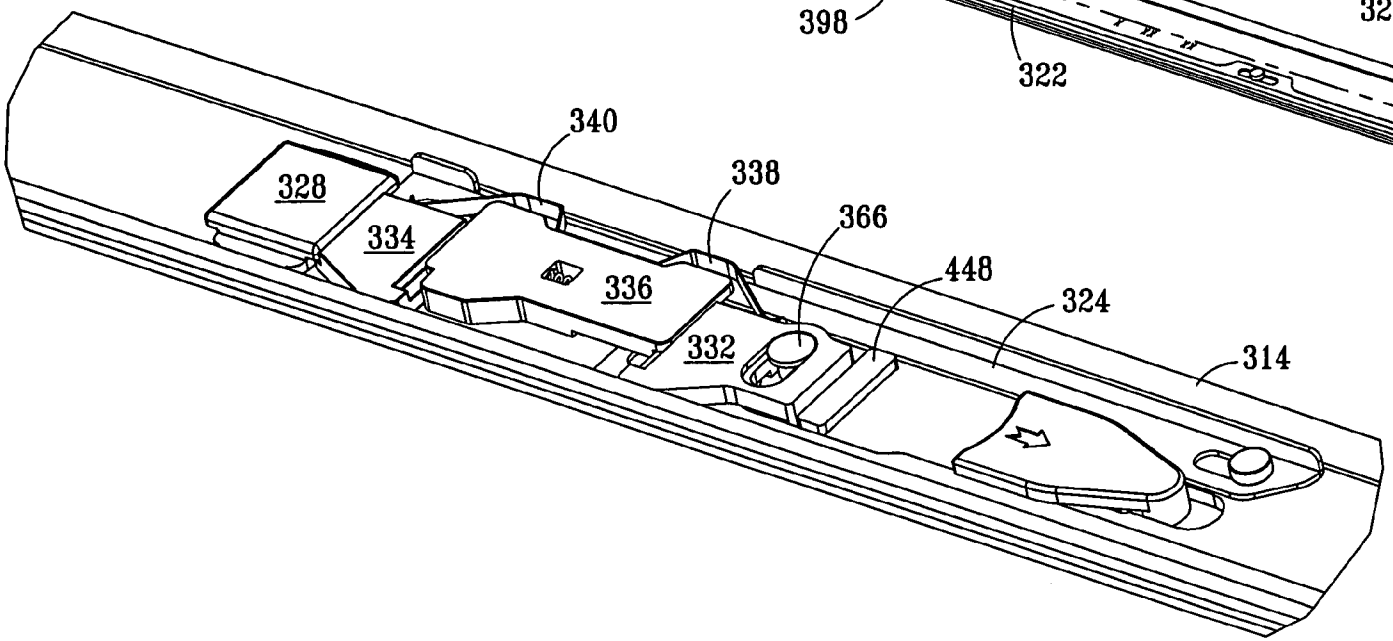

FIG. 19 is a perspective view and FIG. 20 is an enlarged perspective view of a portion of a chassis member 314, which provides a first slide member for a drawer slide 312. The drawer slide 312 has an intermediate member 16 (shown in FIG. 22A), which provides a second slide member, and a cabinet member 18 (shown in FIG. 1 when used in the drawer slide 12), which provides a third slide member. The chassis member 314 has a front release lock with disconnect lock assembly 320 which is provided for selectively locking the chassis member 314 in an extended position, in which the chassis member 314 is extended from within the intermediate member 16, and for selectively locking the chassis member 314 from removal from the intermediate member 16. A front release linkage 322 is provided for selectively operating the front release lock and disconnect lock assembly 320 for releasing the chassis member 314 for moving back into the intermediate member 16 from the extended position. A disconnect linkage 324 is provided for selectively operating the front release lock and disconnect lock assembly 320 for disconnecting the chassis member 314 from the intermediate member 16, such that the chassis member 314 may slide forward of the intermediate member 16 for removal of the chassis member 314 from the intermediate member 16. The stopper 28 is mounted to the intermediate member 16 (shown in FIG. 22A), and the protuberance 30 provides a catch for use in operation of the front release lock and disconnect lock assembly 320.

The front release lock and disconnect lock assembly 320 includes a front release lock 332 and a disconnect lock 334 which are slidably mounted to the chassis member 314 for moving in lineal directions which are transverse to, or perpendicular to, the longitudinal axis 326. The front release lock 332 is secured to the chassis member 314 by means of a bracket 336, a rivet 366 and a guide tab 448 provided by an emboss in the sidewall of the chassis member 314. The disconnect lock 334 is secured to the chassis member 314 by means of a guide block 328 and the bracket 336. A leaf springs 338 engages the front release lock 332 to urge the front release lock 332 into a lock position, and a leaf spring 340 engages the disconnect lock 334 to urge disconnect lock 334 into a retaining position, shown in FIGS. 19 and 20, on opposite sides of the protrusion 30 of the stopper 28 (shown in FIG. 22A).

Figure 21:
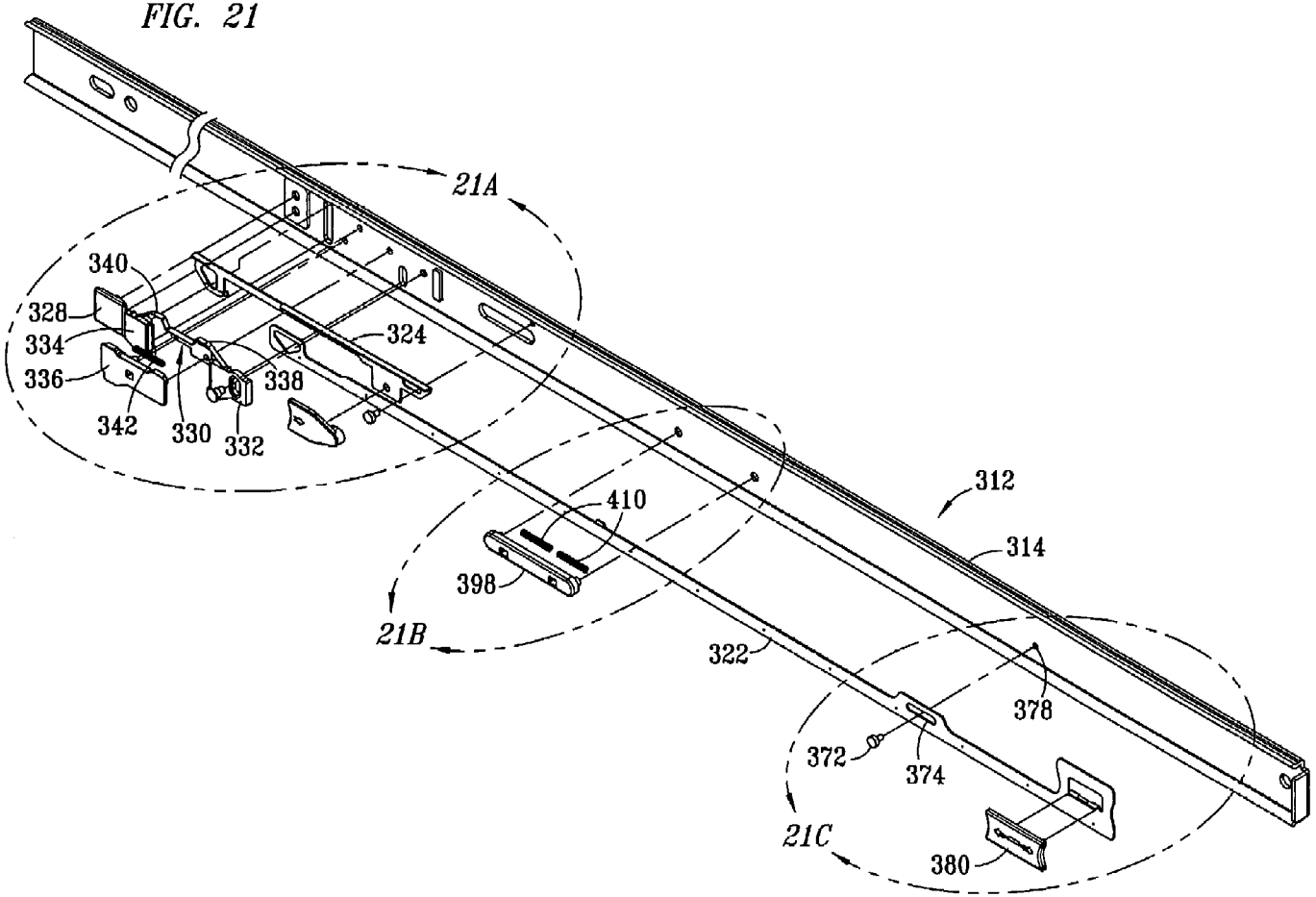
Figure 21A:
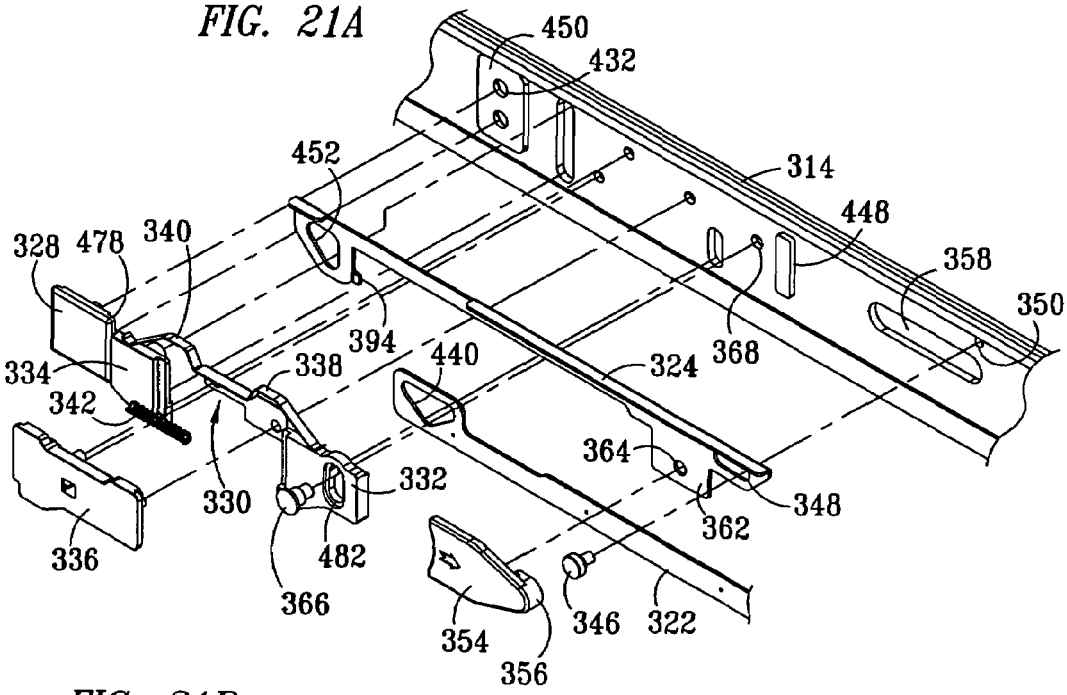
FIGS. 21A, 21B and 21C are an enlarged perspective views of portions of the chassis member of FIG. 21.
Figure 21B:
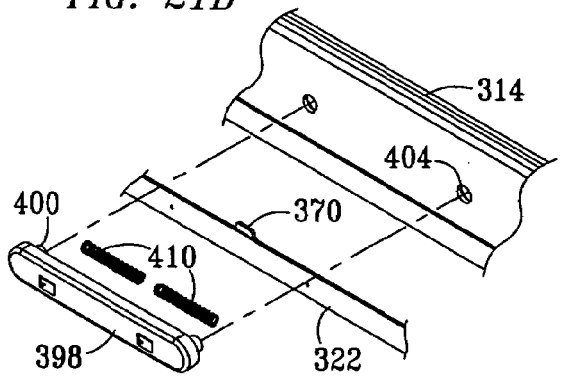
Figure 21C:
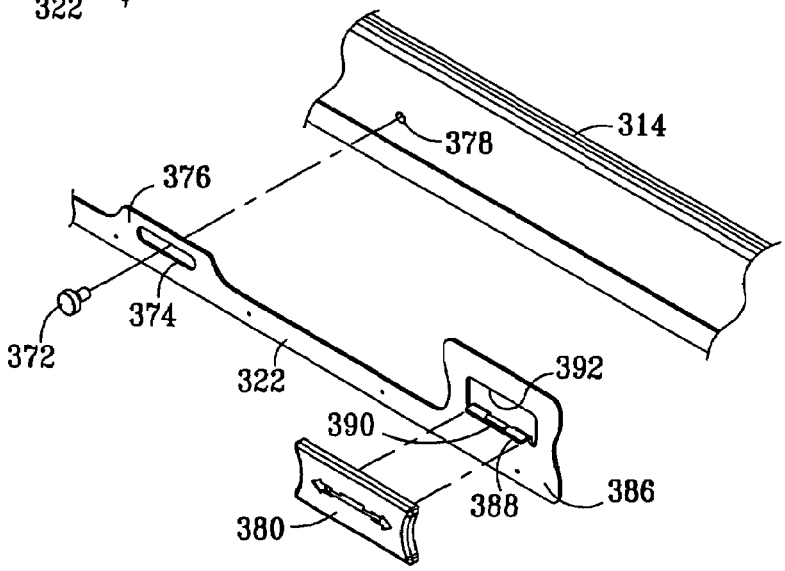
Figure 22:
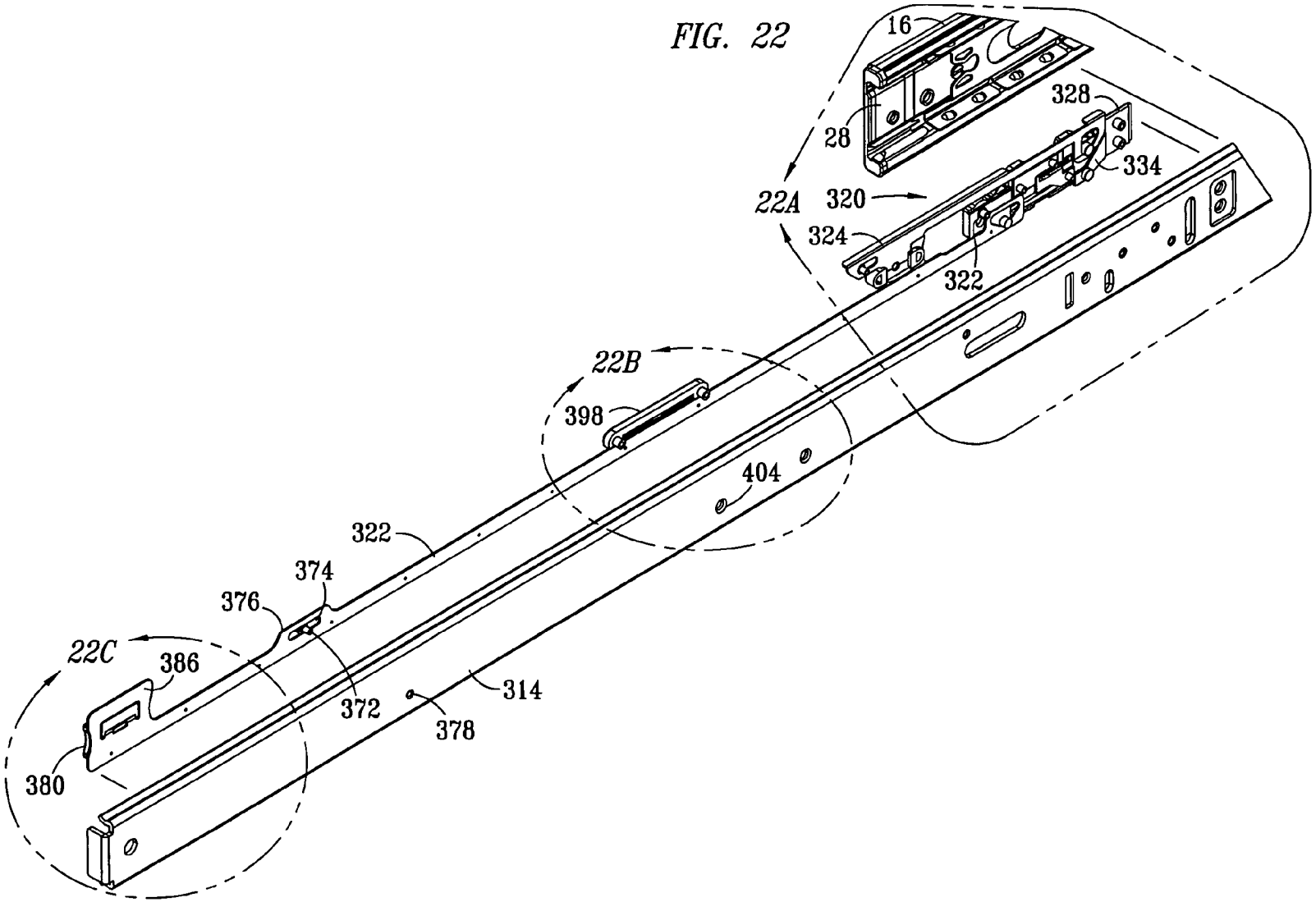
Figure 22A:
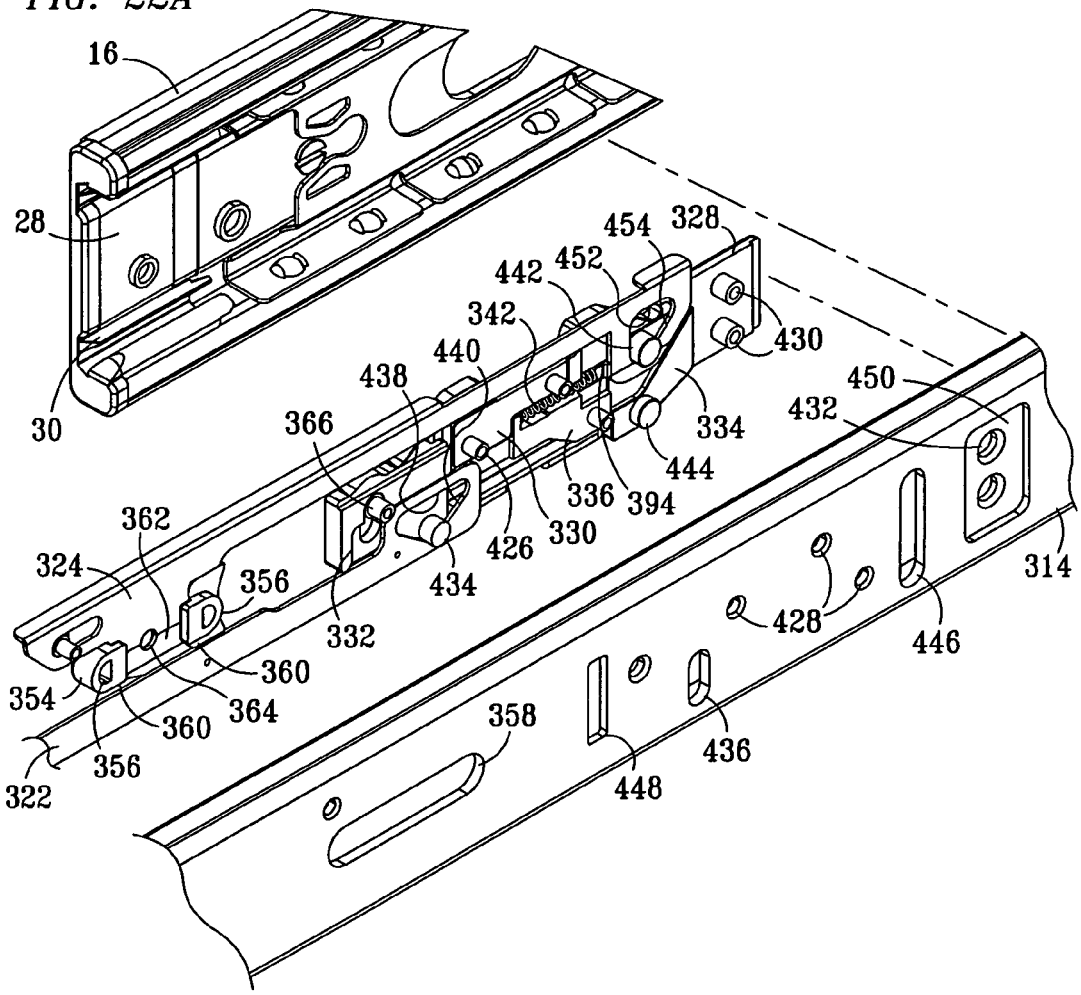
FIGS. 22A, 22B and 22C are enlarged views of portions of FIG. 22.

FIGS. 21 and 22 are exploded, perspective views of opposite sides of the chassis member 314 of the drawer slide 312, and show various components of the front release lock and disconnect lock assembly 320. FIGS. 21A, 21B and 21C are enlarged perspective views of selected portions of the chassis member 314 of FIG. 21, and FIGS. 22A, 22B and 22C are enlarged perspective views of selected portions of the chassis member 314 of FIG. 22. In FIGS. 21A and 22A, a coil spring 342 is shown for locating within a spring slot 344 (see FIG. 33) formed in the bracket 336 for engaging a protuberance provided by a tab 394 of the disconnect linkage 324 for urging the disconnect linkage 324 into a forwardly disposed position. A rivet 366 provides a fastening means for fitting through a guide slot 482 of the front release lock 332 and securing in a mounting hole 368 in the sidewall of the chassis member 314. The two bias springs 338 and 340 are included a part of a spring unit 330 which provides bias means for urging the front release lock 332 and the disconnect lock 334 into positions for engaging the protuberance 30 of the stopper 28. A rivet 346 extends through a guide slot 348 in the disconnect linkage 324 and into a mounting hole 350 within the sidewall of the chassis member 314. A grip member 354 has two tabs 356 which define protuberances which fit within a guide slot 358 defined by a window extending through the sidewall of the chassis member 314. The tabs 356 extend within the guide slot 358 as the disconnect linkage 324 slidably moves along longitudinal axis 326 of the chassis member 314. Lips 360 extend on outward end portions of the tabs 356, spaced apart from a surface of the main body of the grip member 354, for securing a tab portion 362 of the disconnect linkage 324 between the two tabs 356 and the main body of the grip member 354. A hole 364 is defined in the tab 362 of the disconnect linkage 324 in which a mounting fastener or protuberant tab may extend from the grip member 354. The guide block 328 has two protuberant mounting bosses 430 which extend into mounting holes 432 provided in the emboss 450 formed into the sidewall of the chassis member 314.

In FIG. 22A, the stopper 28 is shown mounted to sidewall of the intermediate member 16 with the protuberant portion 30 extending towards the chassis member 314. The front release lock and disconnect lock assembly 320 is shown assembled, but spaced apart from the sidewall of the chassis member 314. The bracket 336 has mounting tabs 426 which are provided for registering with respective ones of mounting holes 428 in the sidewall of the chassis member 314. Preferably, the mounting tabs 426 will either be heat staked, riveted or secured by other types of fasteners, to the sidewall of the chassis member 314 such that the bracket 336 is fixedly secure, in non-moveable relation to the sidewall of the chassis member 314. A guide tab 434 extends from the front release lock 332 toward the chassis member 314 and fits within a guide slot 436 formed in the sidewall of the chassis member 314. A cam aperture 438 defines an opening which extends into an upper side of a rearward end portion of the front release linkage 322 to define a cam surface 440 which engages the guide tab 434 of the front release lock 332. The cam aperture 438 has peripheral edges, or a profile, which defines the cam surface 440 such that forward or rearward movement of the front release linkage 322 from the position show in FIG. 22A moves the guide tab 434 upward. Preferably, the cam aperture 438 has a substantially V-shaped edge which defines the cam surface 440, and in other embodiments may be of other shapes, such as U-shaped, or arcuately-shaped, to extend upwards from opposite sides of a neutral position portion in which the guide tab 434 is disposed within the opening 438 as shown in FIG. 22A. The guide tab 434 and the front release lock 332 define a follower which the cam surface 440 moves aside of the protrusion 30 of the stopper 28, such that the chassis member 314 may be moved from the extended position into the intermediate member 16.

The disconnect lock 334 has two guide tabs 442 and 444 which define protuberances that extend outwardly from the disconnect lock 334 for extending into the guide slot 446 in the sidewall of the chassis member 314. As shown in FIG. 22A, the guide tab 442 is located above the guide gab 444. A cam aperture 452 provides an opening in the rearward end of the disconnect linkage 324, having peripheral edges which define a cam surface 454 for engaging the protuberant guide tab 442 of the disconnect lock 334. Preferably, the cam aperture 452 is formed of a shape to define an edge providing the cam surface 454 which extends with a slope such that forward movement of the disconnect linkage 324 causes the cam surface 454 to push upward against the guide tab 442, urging the disconnect lock 334 to move upward and aside of the protrusion 30 of the stopper 28, such that the chassis member 314 may be removed from within the intermediate member 16. The guide tab 442 is a protuberant member which provides as a follower for engagement with the cam surface 454

Figure 22B:
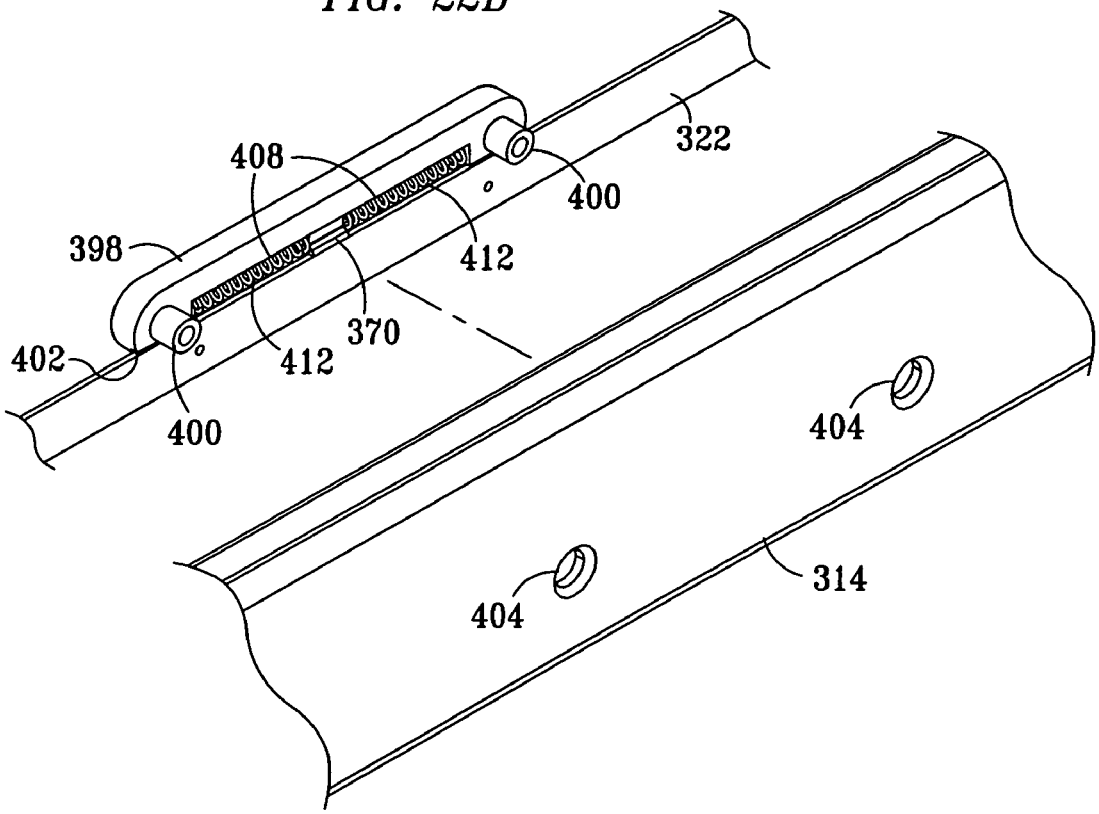
Figure 25:
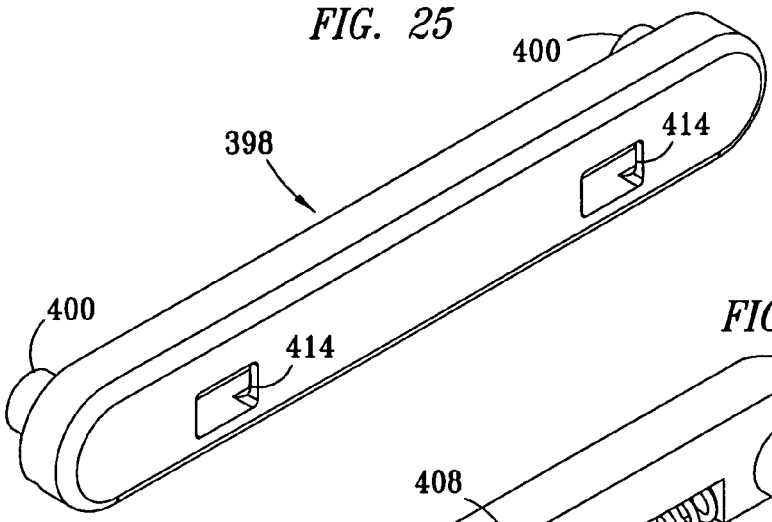
Figure 26:
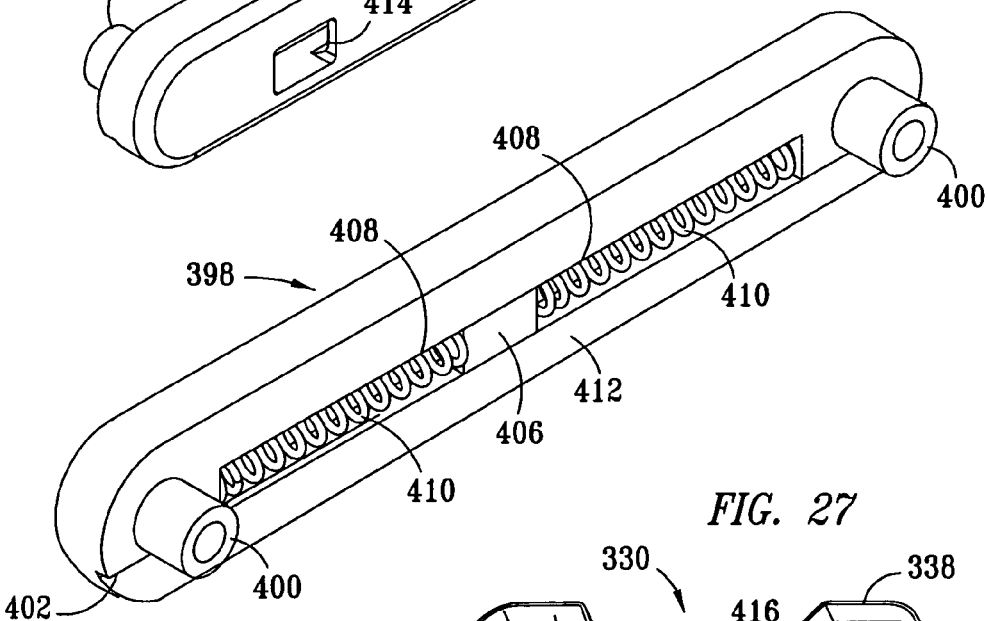

FIGS. 21B and 22B show a spring retainer 398 which is mounted to the chassis member 314. FIGS. 25 and 26 are perspective views showing various details of the spring retainer 398. The spring retainer 398 includes the two mounting tabs 400 which are secured in the mounting holes 404 in the sidewall of the chassis member 314. (See FIG. 21B). A recess 402 is provided on an side which mates against the sidewall of the chassis member 314 for providing a recessed surface 412 to provide clearance for movement of the front release linkage 322 between the recessed surface 412 and the sidewall of the chassis member 314. A spring stop portion 406 is located between two spring cavities 408, and is recessed to provide clearance for passage of the spring engagement tab 370 on the front release linkage 322. (See FIG. 21B). Two coil springs 410 are located in the spring cavities 408 for engaging the spring engagement tab 370, to urge the front release linkage 322 to a neutral position from which the linkage 322 is moved either forward or rearward of the neutral position to move the front release lock 332 to an upwardly disposed position for passing over the protuberance 30 of the stopper 28. Two windows 414 extend from an outward side of the spring retainer 398 into respective ones of the spring cavities 408.

Figure 22C:
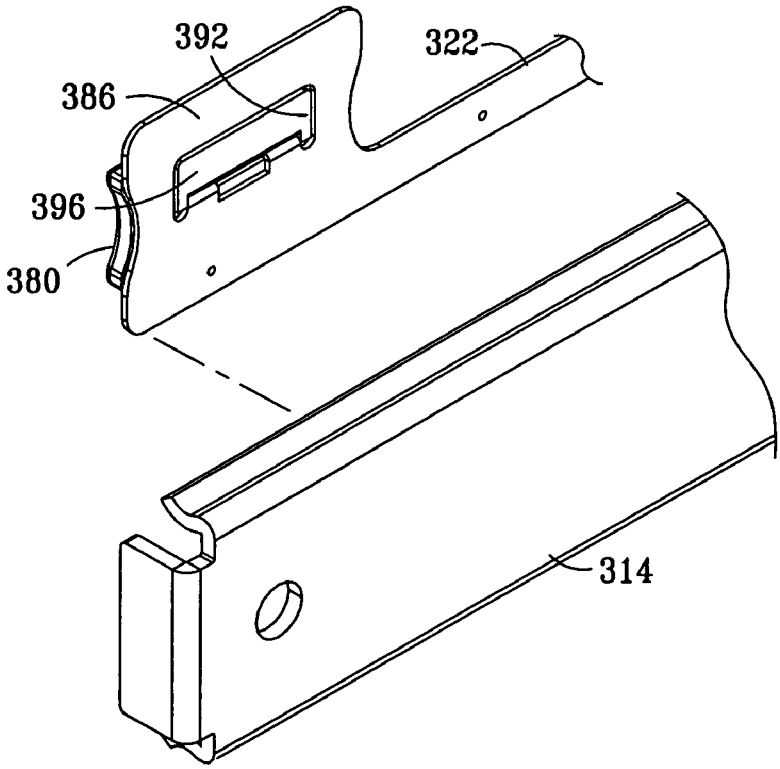

FIGS. 21C and 22C show opposite sides of a forward portion of the chassis member 314 and the front release member 322. A rivet 372 provides a fastening means which extends through a guide slot 374 in an upwardly extending tab portion 376 of the front release member 322, and into a mounting hole 378 in the sidewall of the chassis member 314. A grip member 380 is mounted to an end tab 386 extending from a forward end portion of the front release linkage 322. The end tab 386 of the front release linkage 322 has an aperture 392 forming a window through the end tab 386. A mounting tab 388 extends outwardly from the end tab 386, adjacent an aperture 396. Preferably, a mounting tab 388 extends orthogonal to a planar surface of the end tab 386, and the longitudinal axis 326 of the drawer slide 312, and is received within a mounting hole 382 which is defined by a window extending through the body of the grip member 380. (See FIGS. 23 and 24).

Figure 23:
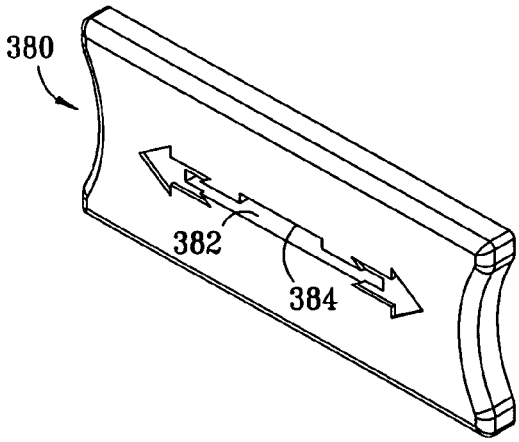
Figure 24:
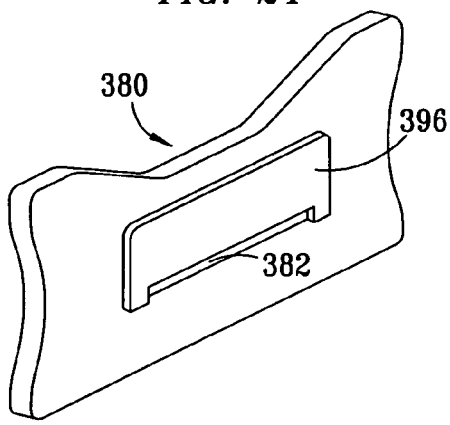

FIGS. 23 and 24 are perspective views of opposite sides of the grip member 380. The mounting hole 382 extends through the main body of the grip member 380. The mounting tab 388 includes an upwardly extending protuberance 390 which fits within an upper portion 384 of the grip member 380. (See FIGS. 23 and 24). The upper portion 384 has a smaller width then the main portion of the mounting hole 302. The grip member 380 includes a raised surface 396 which has a periphery defining peripheral edges which are of a shape for fitting substantially flush against a profile defined by edges of the aperture 392 in the end tab 386 of the release member 322.

Figure 27:
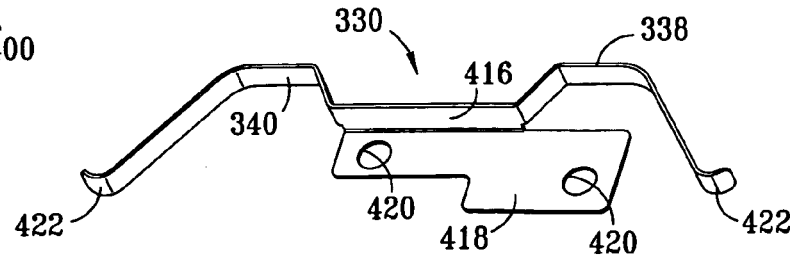

FIG. 27 is a perspective view of the spring unit 330, which provides spring member, or spring means. The spring unit 330 is preferably formed of a single piece of metal and the two leaf springs 338 and 340 extend from an upper portion of the spring unit 330 to provide bias means for pushing against the front release lock 332 and the disconnect lock 334. A connecting portion 416 extends between two oppositely extending strips of metal which provided the springs 338 and 340. The spring unit 330 is formed to provide a back plate portion 418 which extends substantially perpendicular to the flat portions of the connecting portion 416 and the two strips of metal providing the spring arms 338 and 340. Two spaced apart mounting holes 420 are provided in the back plate portion 418 for receiving two of the mounting tabs 426 of the bracket member 336 (see FIG. 22A), such that the spring unit 330 is secured between the chassis member 314 and the bracket member 336 when the bracket member 336 is secured to the chassis member 314. Two engagement portions 422 are provided by forming respective ends of the spring arms 338 and 340 for engaging tops of the front release lock 332 and the disconnect lock 334.

Figure 28:
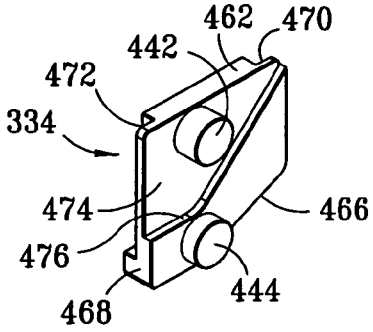
Figure 29:
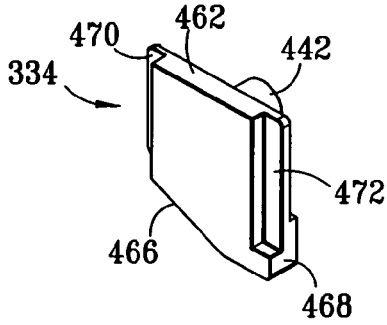

FIGS. 28 and 29 are perspective views of opposite sides of the disconnect lock 334. The two guide tabs 442 and 444 extends outwardly from a side of the disconnect lock 34 to define protuberances which extend into the guide slot 446 in the sidewall of the chassis member 314. See FIG. 22A). A top surface 462 is provided for engaging the bias spring 340. A tapered surface 466 is provided on a rearward portion of the lower end of the disconnect lock 334, such that engagement of the tapered surface 466 with the protuberance 30 of the stopper 28 will urge the disconnect lock 334 to move upward against the force of the bias spring 340 and aside of the protuberance 30 for passing the disconnect lock 334 over the stopper 28 when inserting the chassis member 314 into the intermediate member 16 from a removed position. A stop surface 468 is defined on the forward end of the disconnect lock 334 for engaging the rearward end, or inward end, of the protuberance 30 of the stopper 28 to prevent removal of the chassis member 314 from within the intermediate member 16 once the disconnect lock is located inward of the stopper 28. Lips 470 and 472 are provided for slidably engaging with a respective ones of a lip 506 of the bracket 336 and a lip 478 of the guide block 328 (see FIG. 21A), for slidably retaining the disconnect lock 334 between the bracket 336, the guide block 328, and the sidewall of the chassis member 314. (See FIGS. 21A and 22A). A recessed surface 474 provides clearance for passing the forward end of the disconnect linkage 324 between the disconnect lock 334 and the sidewall of the chassis member 314. The recessed surface 474 defines an edge surface 476 in the body of the disconnect lock 334.

Figure 30:
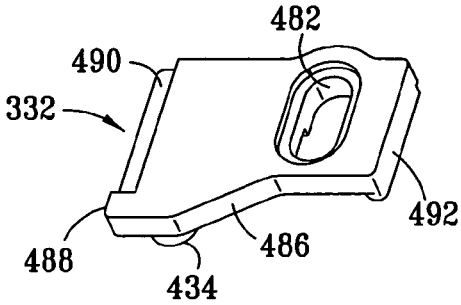
Figure 31:
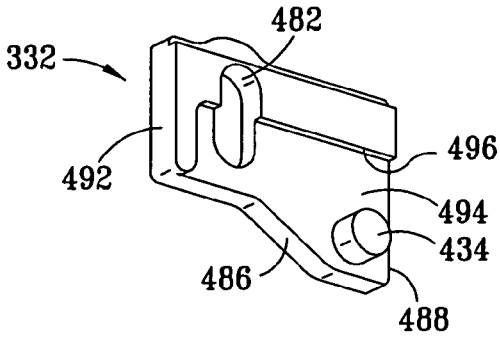

FIGS. 30 and 31 are perspective views of opposite sides of the front release lock 332. The guide tab 434 extends from a side of the front release lock 332. The slot 482 is provided for receiving the rivet 366. (See FIGS. 21A and 22A). The forward portion of the lower end of the release lock 332 has a tapered surface 486, such that when the chassis member 314 is being moved outward from within the intermediate member 16, the tapered surface 486 will engage the rearward end, or inward end, of the protuberant portion 30 of the stopper 28 and move the release lock 332 upwards against the force of the bias spring 338, such that it will pass over the protuberance 30 of the stopper 28. Once the release lock 332 extends beyond the outward side of the protuberant portion 30, the bias spring 338 will urge the release lock 332 downwards such that a rearwardly facing stop surface 488 of the release lock 332 engages the forward end, or outward end, of the protuberance 30 of the stopper 28. The lip 490 is provided on one side of the disconnect lock 332 for slidably engaging a lip 508 of the bracket 336 to slidably retain the forward end of the front release lock 332 against the sidewall of the chassis member 314. (See FIGS. 21A and 22A). A recess surface 494 defines an edge 496, and provides clearance for the front release linkage 322. An edge 492 slidably engages against the guide tab 448 provided by the emboss formed into the sidewall of the chassis member 314.

Figure 32:
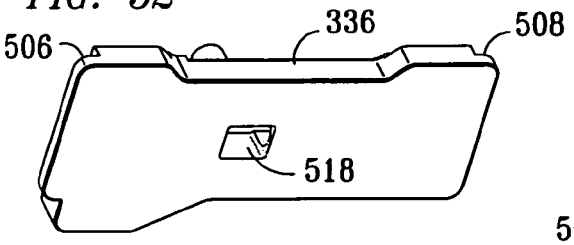
Figure 33:
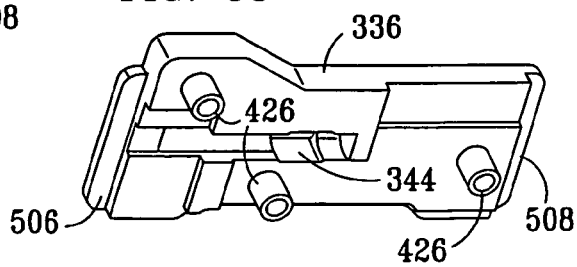

FIGS. 32 and 33 are perspective views of opposite sides of the bracket 336. The mounting tabs 426 extend from a side of the bracket 336 facing the chassis member 314 for engaging within respective ones of the mounting holes 428 in the sidewall of the chassis member 314. (See FIG. 22A). The lips 506 and 508 are provided for slidably engaging respective ones of the lip 472 of the disconnect lock 334, and the lip 490 of front release lock 332. Spring slot 344 extends through an edge of the release bracket 336 for receiving the spring 342. A window 518 extends from one side of the bracket 336 into the slot 344.

Figures 34, 35:
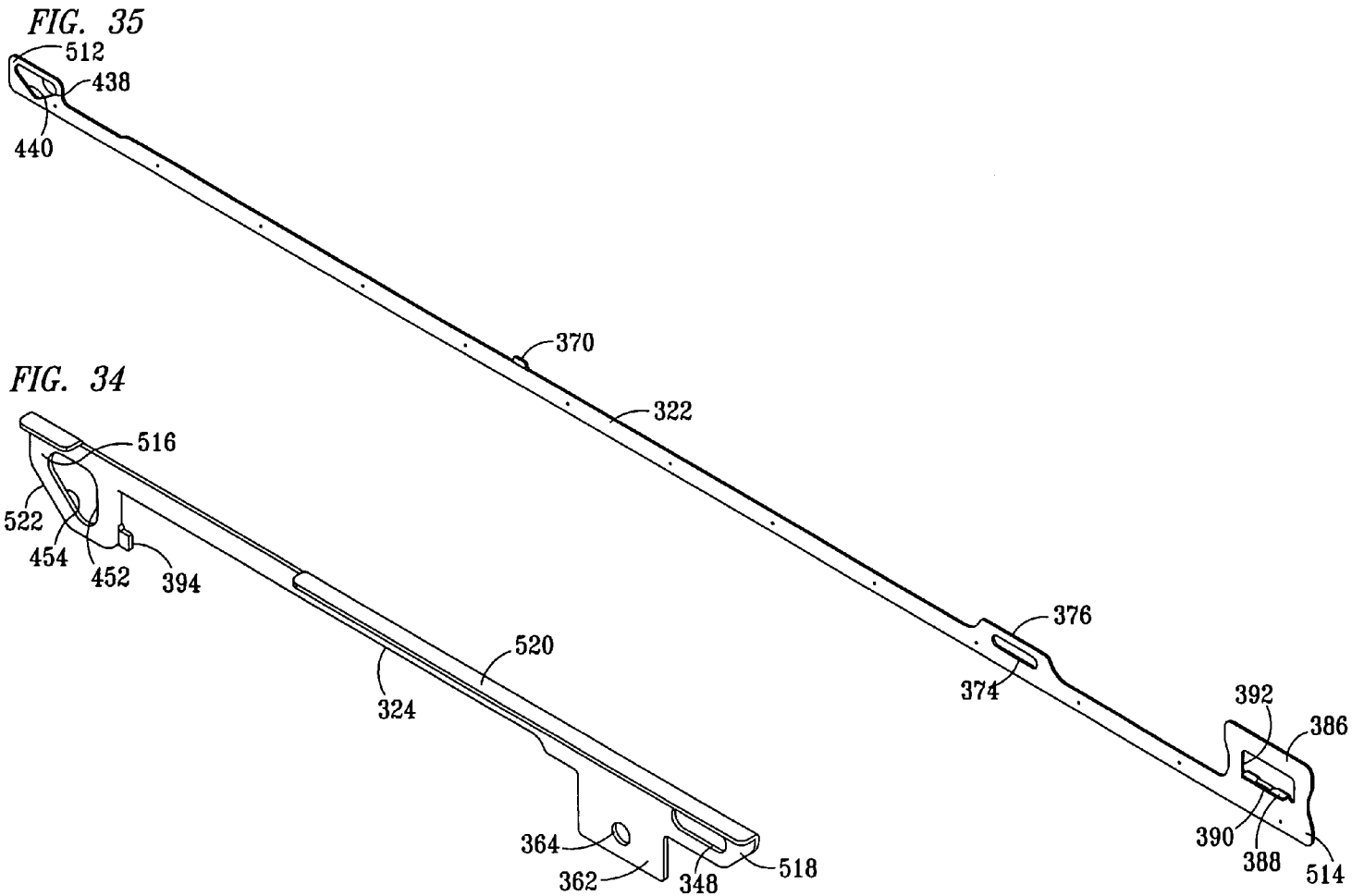

FIG. 34 is a perspective view of the disconnect linkage 324. The disconnect linkage is formed of a strip of metal having a rearward end 516 which includes the cam opening 452 defining the cam surface 454. The rearward end 516 further has an angled surface 522 which fits alongside the edge 476 defined adjacent the recessed surface 474 in the disconnect lock 334. The spring engagement tab 394 extends from a forward end of the window defining the cam opening 452 to provide a stop for engaging the end of the spring 342 which fits within the recess 344 in the bracket 336. Since the bracket 336 is fixed in relation to the chassis member 314, the tab 394 will push against the end of the spring 342 to provide a biasing force to urge the disconnect linkage 322 to return to a rearward position after being moved forward in relation to the chassis member 314 to disengage the disconnect lock 334 from engaging the rearward end of the protuberant portion 30 of the stopper 28. An optional mounting hole 364 is shown in the tab portion 362. The slot 348 extends adjacent the forward end 518 the disconnect linkage 324. An angle portion 520 extends perpendicular to a planar surface of the disconnect linkage 324.

FIG. 35 is a perspective view of the front release linkage 322. The front release linkage is formed of a strip of metal having a rearward end 512 having the cam opening 438 formed therein to define the cam surface 440. The spring engagement tab 370 extends upward in an intermediate portion of the front release linkage 322. A guide slot 374 extends in the tab portion 376. An end 514 of the front release linkage 322 has the tab portion 386 with the window 392 formed therein. The mounting tab 388 extends preferably orthogonal to a planar surface of the tab portion 386, and includes an the upwardly extending, protuberant portion 390.

Thus the advantages of this invention provide a front release lock with disconnect lock having release linkages which allow release of the front release lock and the disconnect lock from positions forward of the respective locks. Bias springs are provided for urging the front release lock and the disconnect lock into locking positions, preventing movement of a chassis member relative to an intermediate member until either the front release lock is selectively moved to a released position, allowing the chassis member to move into the intermediate slide member, or the disconnect lock is selectively moved to a disconnect position, allowing removal of the chassis member from within the intermediate member.

Although the preferred embodiment has been described in detail, it should be understood that various changes, substitutions and alterations can be made therein without departing from the spirit and scope of the invention as defined by the appended claims.

What is claimed is:

1. In a drawer slide having a first slide member and a second slide member, with the first slide member being slideably extensible from the second slide member along a longitudinal axis of the first and second slide members, the improvement comprising:

at least one catch mounted to the second slide member;

a release lock moveably mounted to the first slide member for lineally moving from a lock position to a release position;

a disconnect lock moveably mounted to the first slide member for lineally moving from a retaining position to a disconnect position;

a release linkage slidably secured to the first slide member and extending from forward of said release lock and engaging said release lock, such that movement of said release linkage along the first slide member moves said release lock from said lock position, engaging said at least one catch to said release position, spaced apart from engaging said at least one catch, wherein said release position is spaced apart from said lock position in a lineal direction which extends transverse to the longitudinal axis of the drawer slide;

a disconnect linkage slidably secured to the first slide member and extending from forward of said disconnect lock for engaging said disconnect lock, such that movement of said disconnect linkage along the first slide member moves said disconnect lock from said retaining position to said disconnect position, wherein said retaining position is spaced apart from said disconnect position in a lineal direction which extends transverse to the longitudinal axis of the drawer slide;

bias means for urging said release lock into said lock position and said disconnect lock into said retaining position; and retainer means for slidably securing said release lock and said disconnect lock to the first slide member for moving in respective ones of said lineal directions.

2. The drawer slide according to claim 1, wherein said retainer means comprises a rivet pin.

3. The drawer slide according to claim 2, wherein said retainer means comprises a member mounted in fixed relation to the first drawer slide, and having a lip which engages a mating lip of one of said release lock and said disconnect lock.

4. The drawer slide according to claim 3, wherein said bias means comprise leaf springs.

5. The drawer slide according to claim 1, wherein said retainer means comprises a retainer member having a lip extending from a side thereof for engaging a mating lip defined to extend from said disconnect lock.

6. The drawer slide according to claim 1, wherein said retainer means comprises a lock bracket mounted in fixed relation to the first slide member, said lock bracket having two slots, each for receiving respective ones of said release lock and said disconnect lock.

7. The drawer slide according to claim 6, wherein said lock bracket further comprises lips which extend from respective sides of said slots in said lock bracket, and slidably engage with lips extending from respective ones of said retainer lock and said disconnect lock.

8. The drawer slide according to claim 7, wherein said bias means includes a first bias spring and a second bias spring and said release lock includes a first cavity in which said first bias spring extends and said disconnect lock includes a second cavity in which said second bias spring extends, and said lock bracket further comprises two spring stop tabs each extending into a respective one of said slots in said lock bracket for engaging respective ones of said first and second bias springs disposed in release lock and said disconnect lock.

9. A drawer slide having a first slide member and a second slide member, with the first slide member being slidably extensible from the second slide member along a longitudinal axis of the drawer slide, the drawer slide comprising:

at least one catch mounted to the second slide member;

a release lock slidably mounted to the first slide member for lineally moving from a lock position to a release position;

a disconnect lock slidably mounted to the first slide member for lineally moving from a retaining position to a disconnect position;

a release linkage slidably secured to the first slide member and extending from forward of said release lock and engaging said release lock, such that movement of said release linkage along the first slide member moves said release lock from said lock position, engaging said at least one catch to said release position, spaced apart from engaging said at least one catch, wherein said release position is spaced apart from said lock position in a lineal direction which extends transverse to the longitudinal axis of the drawer slide;

a disconnect linkage slidably secured to the first slide member and extending from forward of said disconnect lock for engaging said disconnect lock, such that movement of said disconnect linkage along the first slide member moves said disconnect lock from said retaining position to said disconnect position, wherein said lock position is spaced apart from said disconnect position in a second lineal direction which extends transverse to the longitudinal axis of the drawer slide;

first and second bias springs, said first bias spring engaging said release lock to urge said release lock into said lock position, and said second bias spring engaging said disconnect lock to urge said disconnect lock into said retaining position; and at least one retainer member mounted to the first slide member for slidably securing said release lock and said disconnect lock to the first slide member, such that said release lock and said disconnect lock are slidably moveable relative to said first slide member.

10. The drawer slide according to claim 9, wherein said at least one retainer member comprises a rivet pin.

11. The drawer slide according to claim 10, wherein said at least one retainer member comprises a member mounted in fixed relation to the first drawer slide, and having a lip which engages a mating lip of one of said release lock and said disconnect lock.

12. The drawer slide according to claim 11, wherein said first and second bias springs comprise leaf springs.

13. The drawer slide according to claim 9, wherein said at least one retainer member comprises a retainer member having a lip extending from a side thereof for engaging a mating lip defined to extend from said disconnect lock.

14. The drawer slide according to claim 9, wherein said at least one retainer member comprises a lock bracket mounted in fixed relation to the first slide member, said lock bracket having two slots, each for receiving respective ones of said release lock and said disconnect lock.

15. The drawer slide according to claim 14, wherein said lock bracket further comprises lips which extend from respective sides of said slots in said lock bracket, and slidably engage with lips extending from respective ones of said retainer lock and said disconnect lock.

16. The drawer slide according to claim 15, wherein said release lock includes a first cavity in which said first bias spring extends and said disconnect lock includes a second cavity in which said second bias spring extends, and said lock bracket further comprises two spring stop tabs each extending into a respective one of said slots in said lock bracket for engaging respective ones of said first and second bias springs disposed in release lock and said disconnect lock.

17. A drawer slide having a first slide member and a second slide member, and a second slide member, with the first slide member being slidably extensible from the second slide member along a longitudinal axis of the drawer slide, the drawer slide comprising:

at least one catch mounted to the second slide member;

a release lock slidably mounted to the first slide member for lineally moving transverse from the longitudinal axis of the drawer slide, from a lock position to a release position;

a disconnect lock slidably mounted to the first slide member for lineally moving transverse to a longitudinal axis of the drawer slide, from a retaining position to a disconnect position;

a release linkage slidably secured to the first slide member and extending from forward of said release lock and engaging said release lock, such that movement of said release linkage along the first slide member moves said release lock from said lock position, engaging said at least one catch to said release position, spaced apart from engaging said at least one catch, wherein said release position is spaced apart from said lock position in a lineal direction which extends transverse to the longitudinal axis of the drawer slide;

a disconnect linkage slidably secured to the first slide member and extending from forward of said disconnect lock for engaging said disconnect lock, such that movement of said disconnect linkage along the first slide member moves said disconnect lock from said retaining position to said disconnect position, wherein said lock position is spaced apart from said disconnect position in a second lineal direction which extends transverse to the longitudinal axis of the drawer slide;

first and second bias springs, said first bias spring engaging said release lock to urge said release lock into said lock position, and said second bias spring engaging said disconnect lock to urge said disconnect lock into said retaining position; and at least one retainer member mounted to the first slide member for slidably securing said release lock and said disconnect lock to the first slide member, such that said release lock and said disconnect lock are slidably moveable in respective ones of said lineal directions.

18. The drawer slide according to claim 17, further comprising:

said at least one retainer member including a rivet pin and a retainer member mounted in fixed relation to the first drawer slide;

said retainer member having two lips which extending for slidably engaging mating lips on respective ones of said release lock and said disconnect lock; and said first and second bias springs comprise leaf springs.

19. The drawer slide according to claim 17, further comprising:

said at least one retainer member including a lock bracket mounted in fixed relation to the first slide member, said lock bracket having two slots, each for receiving respective ones of said release lock and said disconnect lock;

said lock bracket further having lips which extend from respective sides of said slots in said lock bracket, and slidably engage with lips extending from respective ones of said retainer lock and said disconnect lock; and said release lock having a first cavity in which said first bias spring extends and said disconnect lock includes a second cavity in which said second bias spring extends, and said lock bracket further comprises two spring stop tabs each extending into a respective one of said slots in said lock bracket for engaging respective ones of said first and second bias springs disposed in release lock and said disconnect lock.

20. The drawer slide according to claim 17, further comprising a release linkage spring for urging said release linkage to return to a neutral position, and a disconnect linkage spring for urging said disconnect linkage to return to a rearwardly disposed position.

* * * * *